US008616470B2

(12) United States Patent
Williams

(10) Patent No.: US 8,616,470 B2
(45) Date of Patent: Dec. 31, 2013

(54) MODE CONTROL VALVE IN SHOWERHEAD CONNECTOR

(75) Inventor: Brian R. Williams, Fort Collins, CO (US)

(73) Assignee: Water Pik, Inc., Fort Collins, CO (US)

( * ) Notice: Subject to any disclaimer, the term of this patent is extended or adjusted under 35 U.S.C. 154(b) by 387 days.

(21) Appl. No.: 12/868,504

(22) Filed: Aug. 25, 2010

(65) Prior Publication Data

US 2012/0048968 A1 Mar. 1, 2012

(51) Int. Cl.

| | |
|---|---|
| ***F15B 13/00*** | (2006.01) |
| ***F16K 21/00*** | (2006.01) |
| ***A62C 31/00*** | (2006.01) |

(52) U.S. Cl.

USPC ..... 239/445; 239/443; 239/447; 239/449; 137/801

(58) Field of Classification Search

USPC ..... 239/443, 444, 445, 447, 449; 137/801

See application file for complete search history.

(56) References Cited

U.S. PATENT DOCUMENTS

| | | | |
|---|---|---|---|
| 203,094 | A | 4/1878 | Wakeman |
| 204,333 | A | 5/1878 | Josias |
| 309,349 | A | 12/1884 | Hart |
| 428,023 | A | 5/1890 | Schoff |
| 432,712 | A | 7/1890 | Taylor |
| 445,250 | A | 1/1891 | Lawless |
| 453,109 | A | 5/1891 | Dreisorner |
| 486,986 | A | 11/1892 | Schinke |
| 566,384 | A | 8/1896 | Engelhart |
| 566,410 | A | 8/1896 | Schinke |
| 570,405 | A | 10/1896 | Jerguson et al. |
| 694,888 | A | 3/1902 | Pfluger |
| 800,802 | A | 10/1905 | Franquist |
| 832,523 | A | 10/1906 | Andersson |
| 835,678 | A | 11/1906 | Hammond |
| 845,540 | A | 2/1907 | Ferguson |

(Continued)

FOREIGN PATENT DOCUMENTS

| | | |
|---|---|---|
| CA | 659510 | 3/1963 |
| CA | 2341041 | 8/1999 |

(Continued)

OTHER PUBLICATIONS

Author Unknown, "Flipside: The Bolder Look of Kohler," 1 page, at least as early as Jun. 2011.

(Continued)

*Primary Examiner* — Len Tran
*Assistant Examiner* — Justin Jonaitis
(74) *Attorney, Agent, or Firm* — Dorsey & Whitney LLP

(57) ABSTRACT

A showerhead system includes an arm structure adapted to couple to a water pipe to receive water flow therefrom. The arm structure includes a first fluid conduit, a second fluid conduit, and a mode selector operatively coupled to the first fluid conduit and the second fluid conduit. The mode selector transitions between a first setting to direct water flow from a first chamber to a second chamber positioned below the first chamber and a second setting to direct water flow from the first chamber to a third chamber positioned below the first chamber. The second chamber is in fluid communication with the first fluid conduit and the third chamber is in fluid communication with the second fluid conduit. The showerhead system further includes a spray head configured to distribute the water from at least one of the first and second the fluid conduits.

23 Claims, 9 Drawing Sheets

(56) References Cited

U.S. PATENT DOCUMENTS

| | | | |
|---|---|---|---|
| 854,094 | A | 5/1907 | Klein |
| 926,929 | A | 7/1909 | Dusseau |
| 1,001,842 | A | 8/1911 | Greenfield |
| 1,003,037 | A | 9/1911 | Crowe |
| 1,018,143 | A | 2/1912 | Vissering |
| 1,046,573 | A | 12/1912 | Ellis |
| 1,130,520 | A | 3/1915 | Kenney |
| 1,203,466 | A | 10/1916 | Benson |
| 1,217,254 | A | 2/1917 | Winslow |
| 1,218,895 | A | 3/1917 | Porter |
| 1,255,577 | A | 2/1918 | Berry |
| 1,260,181 | A | 3/1918 | Garnero |
| 1,276,117 | A | 8/1918 | Riebe |
| 1,284,099 | A | 11/1918 | Harris |
| 1,327,428 | A | 1/1920 | Gregory |
| 1,451,800 | A | 4/1923 | Agner |
| 1,459,582 | A | 6/1923 | Dubee |
| 1,469,528 | A | 10/1923 | Owens |
| 1,500,921 | A | 7/1924 | Bramson et al. |
| 1,560,789 | A | 11/1925 | Johnson et al. |
| 1,597,477 | A | 8/1926 | Panhorst |
| 1,633,531 | A | 6/1927 | Keller |
| 1,692,394 | A | 11/1928 | Sundh |
| 1,695,263 | A | 12/1928 | Jacques |
| 1,724,147 | A | 8/1929 | Russell |
| 1,724,161 | A | 8/1929 | Wuesthoff |
| 1,736,160 | A | 11/1929 | Jonsson |
| 1,754,127 | A | 4/1930 | Srulowitz |
| 1,758,115 | A | 5/1930 | Kelly |
| 1,778,658 | A | 10/1930 | Baker |
| 1,821,274 | A | 9/1931 | Plummer |
| 1,849,517 | A | 3/1932 | Fraser |
| 1,890,156 | A | 12/1932 | Konig |
| 1,906,575 | A | 5/1933 | Goeriz |
| 1,934,553 | A | 11/1933 | Mueller et al. |
| 1,946,207 | A | 2/1934 | Haire |
| 2,011,446 | A | 8/1935 | Judell |
| 2,024,930 | A | 12/1935 | Judell |
| 2,033,467 | A | 3/1936 | Groeniger |
| 2,044,445 | A | 6/1936 | Price et al. |
| 2,085,854 | A | 7/1937 | Hathaway et al. |
| 2,096,912 | A | 10/1937 | Morris |
| 2,117,152 | A | 5/1938 | Crosti |
| D113,439 | S | 2/1939 | Reinecke |
| 2,196,783 | A | 4/1940 | Shook |
| 2,197,667 | A | 4/1940 | Shook |
| 2,216,149 | A | 10/1940 | Weiss |
| D126,433 | S | 4/1941 | Enthof |
| 2,251,192 | A | 7/1941 | Krumsiek et al. |
| 2,268,263 | A | 12/1941 | Newell et al. |
| 2,285,831 | A | 6/1942 | Pennypacker |
| 2,342,757 | A | 2/1944 | Roser |
| 2,402,741 | A | 6/1946 | Draviner |
| D147,258 | S | 8/1947 | Becker |
| D152,584 | S | 2/1949 | Becker |
| 2,467,954 | A | 4/1949 | Becker |
| 2,546,348 | A | 3/1951 | Schuman |
| 2,567,642 | A | 9/1951 | Penshaw |
| 2,581,129 | A | 1/1952 | Muldoon |
| D166,073 | S | 3/1952 | Dunkelberger |
| 2,648,762 | A | 8/1953 | Dunkelberger |
| 2,664,271 | A | 12/1953 | Arutunoff |
| 2,671,693 | A | 3/1954 | Hyser et al. |
| 2,676,806 | A | 4/1954 | Bachman |
| 2,679,575 | A | 5/1954 | Haberstump |
| 2,680,358 | A | 6/1954 | Zublin |
| 2,726,120 | A | 12/1955 | Bletcher et al. |
| 2,759,765 | A | 8/1956 | Pawley |
| 2,776,168 | A | 1/1957 | Schweda |
| 2,792,847 | A | 5/1957 | Spencer |
| 2,873,999 | A | 2/1959 | Webb |
| 2,930,505 | A | 3/1960 | Meyer |
| 2,931,672 | A | 4/1960 | Merritt et al. |
| 2,935,265 | A | 5/1960 | Richter |
| 2,949,242 | A | 8/1960 | Blumberg et al. |
| 2,957,587 | A | 10/1960 | Tobin |
| 2,966,311 | A | 12/1960 | Davis |
| D190,295 | S | 5/1961 | Becker |
| 2,992,437 | A | 7/1961 | Nelson et al. |
| 3,007,648 | A | 11/1961 | Fraser |
| D192,935 | S | 5/1962 | Becker |
| 3,032,357 | A | 5/1962 | Shames et al. |
| 3,034,809 | A | 5/1962 | Greenberg |
| 3,037,799 | A | 6/1962 | Mulac |
| 3,081,339 | A | 3/1963 | Green et al. |
| 3,092,333 | A | 6/1963 | Gaiotto |
| 3,098,508 | A | 7/1963 | Gerdes |
| 3,103,723 | A | 9/1963 | Becker |
| 3,104,815 | A | 9/1963 | Schultz |
| 3,104,827 | A | 9/1963 | Aghnides |
| 3,111,277 | A | 11/1963 | Grimsley |
| 3,112,073 | A | 11/1963 | Larson et al. |
| 3,143,857 | A | 8/1964 | Eaton |
| 3,196,463 | A | 7/1965 | Farneth |
| 3,231,200 | A | 1/1966 | Heald |
| 3,236,545 | A | 2/1966 | Parkes et al. |
| 3,239,152 | A | 3/1966 | Bachli et al. |
| 3,266,059 | A | 8/1966 | Stelle |
| 3,272,437 | A | 9/1966 | Coson |
| 3,273,359 | A | 9/1966 | Fregeolle |
| 3,306,634 | A | 2/1967 | Groves et al. |
| 3,323,148 | A | 6/1967 | Burnon |
| 3,329,967 | A | 7/1967 | Martinez et al. |
| 3,341,132 | A | 9/1967 | Parkison |
| 3,342,419 | A | 9/1967 | Weese |
| 3,344,994 | A | 10/1967 | Fife |
| 3,363,842 | A | 1/1968 | Burns |
| 3,383,051 | A | 5/1968 | Fiorentino |
| 3,389,925 | A | 6/1968 | Gottschald |
| 3,393,311 | A | 7/1968 | Dahl |
| 3,393,312 | A | 7/1968 | Dahl |
| 3,404,410 | A | 10/1968 | Sumida |
| 3,492,029 | A | 1/1970 | French et al. |
| 3,516,611 | A | 6/1970 | Piggott |
| 3,546,961 | A | 12/1970 | Marton |
| 3,550,863 | A | 12/1970 | McDermott |
| 3,552,436 | A | 1/1971 | Stewart |
| 3,565,116 | A | 2/1971 | Gabin |
| 3,566,917 | A | 3/1971 | White |
| 3,580,513 | A | 5/1971 | Martin |
| 3,584,822 | A | 6/1971 | Oram |
| 3,596,835 | A | 8/1971 | Smith et al. |
| 3,612,577 | A | 10/1971 | Pope et al. |
| 3,637,143 | A | 1/1972 | Shames et al. |
| 3,641,333 | A | 2/1972 | Gendron |
| 3,647,144 | A | 3/1972 | Parkison et al. |
| 3,663,044 | A | 5/1972 | Contreras et al. |
| 3,669,470 | A | 6/1972 | Deurloo |
| 3,672,648 | A | 6/1972 | Price |
| 3,682,392 | A | 8/1972 | Kint |
| 3,685,745 | A | 8/1972 | Peschcke-koedt |
| D224,834 | S | 9/1972 | Laudell |
| 3,711,029 | A | 1/1973 | Bartlett |
| 3,722,798 | A | 3/1973 | Bletcher et al. |
| 3,722,799 | A | 3/1973 | Rauh |
| 3,731,084 | A | 5/1973 | Trevorrow |
| 3,754,779 | A | 8/1973 | Peress |
| D228,622 | S | 10/1973 | Juhlin |
| 3,762,648 | A | 10/1973 | Deines et al. |
| 3,768,735 | A | 10/1973 | Ward |
| 3,786,995 | A | 1/1974 | Manoogian et al. |
| 3,801,019 | A | 4/1974 | Trenary et al. |
| 3,810,580 | A | 5/1974 | Rauh |
| 3,826,454 | A | 7/1974 | Zieger |
| 3,840,734 | A | 10/1974 | Oram |
| 3,845,291 | A | 10/1974 | Portyrata |
| 3,860,271 | A | 1/1975 | Rodgers |
| 3,861,719 | A | 1/1975 | Hand |
| 3,865,310 | A | 2/1975 | Elkins et al. |
| 3,869,151 | A | 3/1975 | Fletcher et al. |
| 3,896,845 | A | 7/1975 | Parker |
| 3,902,671 | A | 9/1975 | Symmons |
| 3,910,277 | A | 10/1975 | Zimmer |
| D237,708 | S | 11/1975 | Grohe |

(56) References Cited

U.S. PATENT DOCUMENTS

| | | | |
|---|---|---|---|
| 3,929,164 | A | 12/1975 | Richter |
| 3,929,287 | A | 12/1975 | Givler et al. |
| 3,958,756 | A | 5/1976 | Trenary et al. |
| D240,322 | S | 6/1976 | Staub |
| 3,963,179 | A | 6/1976 | Tomaro |
| 3,967,783 | A | 7/1976 | Halsted et al. |
| 3,979,096 | A | 9/1976 | Zieger |
| 3,997,116 | A | 12/1976 | Moen |
| 3,998,390 | A | 12/1976 | Peterson et al. |
| 3,999,714 | A | 12/1976 | Lang |
| 4,005,880 | A | 2/1977 | Anderson et al. |
| 4,006,920 | A | 2/1977 | Sadler et al. |
| 4,023,782 | A | 5/1977 | Eifer |
| 4,042,984 | A | 8/1977 | Butler |
| 4,045,054 | A | 8/1977 | Arnold |
| D245,858 | S | 9/1977 | Grube |
| D245,860 | S | 9/1977 | Grube |
| 4,068,801 | A | 1/1978 | Leutheuser |
| 4,081,135 | A | 3/1978 | Tomaro |
| 4,084,271 | A | 4/1978 | Ginsberg |
| 4,091,998 | A | 5/1978 | Peterson |
| D249,356 | S | 9/1978 | Nagy |
| 4,117,979 | A | 10/1978 | Lagarelli et al. |
| 4,129,257 | A | 12/1978 | Eggert |
| 4,130,120 | A | 12/1978 | Kohler, Jr. |
| 4,131,233 | A | 12/1978 | Koenig |
| 4,133,486 | A | 1/1979 | Fanella |
| 4,135,549 | A | 1/1979 | Baker |
| D251,045 | S | 2/1979 | Grube |
| 4,141,502 | A | 2/1979 | Grohe |
| 4,151,955 | A | 5/1979 | Stouffer |
| 4,151,957 | A | 5/1979 | Gecewicz et al. |
| 4,162,801 | A | 7/1979 | Kresky et al. |
| 4,165,837 | A | 8/1979 | Rundzaitis |
| 4,167,196 | A | 9/1979 | Morris |
| 4,174,822 | A | 11/1979 | Larsson |
| 4,185,781 | A | 1/1980 | O'Brien |
| 4,190,207 | A | 2/1980 | Fienhold et al. |
| 4,191,332 | A | 3/1980 | De Langis et al. |
| 4,203,550 | A | 5/1980 | On |
| 4,209,132 | A | 6/1980 | Kwan |
| D255,626 | S | 7/1980 | Grube |
| 4,219,160 | A | 8/1980 | Allred, Jr. |
| 4,221,338 | A | 9/1980 | Shames et al. |
| 4,239,409 | A | 12/1980 | Osrow |
| 4,243,253 | A | 1/1981 | Rogers, Jr. |
| 4,244,526 | A | 1/1981 | Arth |
| D258,677 | S | 3/1981 | Larsson |
| 4,254,914 | A | 3/1981 | Shames et al. |
| 4,258,414 | A | 3/1981 | Sokol |
| 4,272,022 | A | 6/1981 | Evans |
| 4,274,400 | A | 6/1981 | Baus |
| 4,282,612 | A | 8/1981 | King |
| D261,300 | S | 10/1981 | Klose |
| D261,417 | S | 10/1981 | Klose |
| 4,303,201 | A | 12/1981 | Elkins et al. |
| 4,319,608 | A | 3/1982 | Raikov et al. |
| 4,330,089 | A | 5/1982 | Finkbeiner |
| D266,212 | S | 9/1982 | Haug et al. |
| 4,350,298 | A | 9/1982 | Tada |
| 4,353,508 | A | 10/1982 | Butterfield et al. |
| 4,358,056 | A | 11/1982 | Greenhut et al. |
| D267,582 | S | 1/1983 | Mackay et al. |
| D268,359 | S | 3/1983 | Klose |
| D268,442 | S | 3/1983 | Darmon |
| D268,611 | S | 4/1983 | Klose |
| 4,383,554 | A | 5/1983 | Merriman |
| 4,396,797 | A | 8/1983 | Sakuragi et al. |
| 4,398,669 | A | 8/1983 | Fienhold |
| 4,425,965 | A | 1/1984 | Bayh, III et al. |
| 4,432,392 | A | 2/1984 | Paley |
| D274,457 | S | 6/1984 | Haug |
| 4,461,052 | A | 7/1984 | Mostul |
| 4,465,308 | A | 8/1984 | Martini |
| 4,467,964 | A | 8/1984 | Kaeser |
| 4,495,550 | A | 1/1985 | Visciano |
| 4,527,745 | A | 7/1985 | Butterfield et al. |
| 4,540,202 | A | 9/1985 | Amphoux et al. |
| 4,545,081 | A | 10/1985 | Nestor et al. |
| 4,553,775 | A | 11/1985 | Halling |
| D281,820 | S | 12/1985 | Oba et al. |
| 4,561,593 | A | 12/1985 | Cammack et al. |
| 4,564,889 | A | 1/1986 | Bolson |
| 4,571,003 | A | 2/1986 | Roling et al. |
| 4,572,232 | A | 2/1986 | Gruber |
| D283,645 | S | 4/1986 | Tanaka |
| 4,587,991 | A | 5/1986 | Chorkey |
| 4,588,130 | A | 5/1986 | Trenary et al. |
| 4,598,866 | A | 7/1986 | Cammack et al. |
| 4,614,303 | A | 9/1986 | Moseley, Jr. et al. |
| 4,616,298 | A | 10/1986 | Bolson |
| 4,618,100 | A | 10/1986 | White et al. |
| 4,629,124 | A | 12/1986 | Gruber |
| 4,629,125 | A | 12/1986 | Liu |
| 4,643,463 | A | 2/1987 | Halling et al. |
| 4,645,244 | A | 2/1987 | Curtis |
| RE32,386 | E | 3/1987 | Hunter |
| 4,650,120 | A | 3/1987 | Kress |
| 4,650,470 | A | 3/1987 | Epstein |
| 4,652,025 | A | 3/1987 | Conroy, Sr. |
| 4,654,900 | A | 4/1987 | McGhee |
| 4,657,185 | A | 4/1987 | Rundzaitis |
| 4,669,666 | A | 6/1987 | Finkbeiner |
| 4,669,757 | A | 6/1987 | Bartholomew |
| 4,674,687 | A | 6/1987 | Smith et al. |
| 4,683,917 | A | 8/1987 | Bartholomew |
| 4,703,893 | A | 11/1987 | Gruber |
| 4,717,180 | A | 1/1988 | Roman |
| 4,719,654 | A | 1/1988 | Blessing |
| 4,733,337 | A | 3/1988 | Bieberstein |
| D295,437 | S | 4/1988 | Fabian |
| 4,739,801 | A | 4/1988 | Kimura et al. |
| 4,749,126 | A | 6/1988 | Kessener et al. |
| D296,582 | S | 7/1988 | Haug et al. |
| 4,754,928 | A | 7/1988 | Rogers et al. |
| D297,160 | S | 8/1988 | Robbins |
| 4,764,047 | A | 8/1988 | Johnston et al. |
| 4,778,104 | A | 10/1988 | Fisher |
| 4,787,591 | A | 11/1988 | Villacorta |
| 4,790,294 | A | 12/1988 | Allred, III et al. |
| 4,801,091 | A | 1/1989 | Sandvik |
| 4,809,369 | A | 3/1989 | Bowden |
| 4,839,599 | A | 6/1989 | Fischer |
| 4,842,059 | A | 6/1989 | Tomek |
| D302,325 | S | 7/1989 | Charet et al. |
| 4,850,616 | A | 7/1989 | Pava |
| 4,854,499 | A | 8/1989 | Neuman |
| 4,856,822 | A | 8/1989 | Parker |
| 4,865,362 | A | 9/1989 | Holden |
| D303,830 | S | 10/1989 | Ramsey et al. |
| 4,871,196 | A | 10/1989 | Kingsford |
| 4,896,658 | A | 1/1990 | Yonekubo et al. |
| D306,351 | S | 2/1990 | Charet et al. |
| 4,901,927 | A | 2/1990 | Valdivia |
| 4,903,178 | A | 2/1990 | Englot et al. |
| 4,903,897 | A | 2/1990 | Hayes |
| 4,903,922 | A | 2/1990 | Harris, III |
| 4,907,137 | A | 3/1990 | Schladitz et al. |
| 4,907,744 | A | 3/1990 | Jousson |
| 4,909,435 | A | 3/1990 | Kidouchi et al. |
| 4,914,759 | A | 4/1990 | Goff |
| 4,946,202 | A | 8/1990 | Perricone |
| 4,951,329 | A | 8/1990 | Shaw |
| 4,953,585 | A | 9/1990 | Rollini et al. |
| 4,964,573 | A | 10/1990 | Lipski |
| 4,972,048 | A | 11/1990 | Martin |
| D313,267 | S | 12/1990 | Lenci et al. |
| 4,976,460 | A | 12/1990 | Newcombe et al. |
| D314,246 | S | 1/1991 | Bache |
| D315,191 | S | 3/1991 | Mikol |
| 4,998,673 | A | 3/1991 | Pilolla |
| 5,004,158 | A | 4/1991 | Halem et al. |
| D317,348 | S | 6/1991 | Geneve et al. |
| 5,020,570 | A | 6/1991 | Cotter |

(56) References Cited

U.S. PATENT DOCUMENTS

| | | | |
|---|---|---|---|
| 5,022,103 | A | 6/1991 | Faist |
| 5,032,015 | A | 7/1991 | Christianson |
| 5,033,528 | A | 7/1991 | Volcani |
| 5,033,897 | A | 7/1991 | Chen |
| D319,294 | S | 8/1991 | Kohler, Jr. et al. |
| D320,064 | S | 9/1991 | Presman |
| 5,046,764 | A | 9/1991 | Kimura et al. |
| D321,062 | S | 10/1991 | Bonbright |
| 5,058,804 | A | 10/1991 | Yonekubo et al. |
| D322,119 | S | 12/1991 | Haug et al. |
| D322,681 | S | 12/1991 | Yuen |
| 5,070,552 | A | 12/1991 | Gentry et al. |
| D323,545 | S | 1/1992 | Ward |
| 5,082,019 | A | 1/1992 | Tetrault |
| 5,086,878 | A | 2/1992 | Swift |
| 5,090,624 | A | 2/1992 | Rogers |
| 5,100,055 | A | 3/1992 | Rokitenetz et al. |
| D325,769 | S | 4/1992 | Haug et al. |
| D325,770 | S | 4/1992 | Haug et al. |
| 5,103,384 | A | 4/1992 | Drohan |
| D326,311 | S | 5/1992 | Lenci et al. |
| D327,115 | S | 6/1992 | Rogers |
| 5,121,511 | A | 6/1992 | Sakamoto et al. |
| D327,729 | S | 7/1992 | Rogers |
| 5,127,580 | A | 7/1992 | Fu-I |
| 5,134,251 | A | 7/1992 | Martin |
| D328,944 | S | 8/1992 | Robbins |
| 5,141,016 | A | 8/1992 | Nowicki |
| D329,504 | S | 9/1992 | Yuen |
| 5,143,300 | A | 9/1992 | Cutler |
| 5,145,114 | A | 9/1992 | Monch |
| 5,148,556 | A | 9/1992 | Bottoms, Jr. et al. |
| D330,068 | S | 10/1992 | Haug et al. |
| D330,408 | S | 10/1992 | Thacker |
| D330,409 | S | 10/1992 | Raffo |
| 5,153,976 | A | 10/1992 | Benchaar et al. |
| 5,154,355 | A | 10/1992 | Gonzalez |
| 5,154,483 | A | 10/1992 | Zeller |
| 5,161,567 | A | 11/1992 | Humpert |
| 5,163,752 | A | 11/1992 | Copeland et al. |
| 5,171,429 | A | 12/1992 | Yasuo |
| 5,172,860 | A | 12/1992 | Yuch |
| 5,172,862 | A | 12/1992 | Heimann et al. |
| 5,172,866 | A | 12/1992 | Ward |
| D332,303 | S | 1/1993 | Klose |
| D332,994 | S | 2/1993 | Huen |
| D333,339 | S | 2/1993 | Klose |
| 5,197,767 | A | 3/1993 | Kimura et al. |
| D334,794 | S | 4/1993 | Klose |
| D335,171 | S | 4/1993 | Lenci et al. |
| 5,201,468 | A | 4/1993 | Freier et al. |
| 5,206,963 | A | 5/1993 | Wiens |
| 5,207,499 | A | 5/1993 | Vajda et al. |
| 5,213,267 | A | 5/1993 | Heimann et al. |
| 5,220,697 | A | 6/1993 | Birchfield |
| D337,839 | S | 7/1993 | Zeller |
| 5,228,625 | A | 7/1993 | Grassberger |
| 5,230,106 | A | 7/1993 | Henkin et al. |
| D338,542 | S | 8/1993 | Yuen |
| 5,232,162 | A | 8/1993 | Chih |
| D339,492 | S | 9/1993 | Klose |
| D339,627 | S | 9/1993 | Klose |
| D339,848 | S | 9/1993 | Gottwald |
| 5,246,169 | A | 9/1993 | Heimann et al. |
| 5,246,301 | A | 9/1993 | Hirasawa |
| D340,376 | S | 10/1993 | Klose |
| 5,253,670 | A | 10/1993 | Perrott |
| 5,253,807 | A | 10/1993 | Newbegin |
| 5,254,809 | A | 10/1993 | Martin |
| D341,007 | S | 11/1993 | Haug et al. |
| D341,191 | S | 11/1993 | Klose |
| D341,220 | S | 11/1993 | Eagan |
| 5,263,646 | A | 11/1993 | McCauley |
| 5,265,833 | A | 11/1993 | Heimann et al. |
| 5,268,826 | A | 12/1993 | Greene |
| 5,276,596 | A | 1/1994 | Krenzel |
| 5,277,391 | A | 1/1994 | Haug et al. |
| 5,286,071 | A | 2/1994 | Storage |
| 5,288,110 | A | 2/1994 | Allread |
| 5,294,054 | A | 3/1994 | Benedict et al. |
| 5,297,735 | A | 3/1994 | Heimann et al. |
| 5,297,739 | A | 3/1994 | Allen |
| D345,811 | S | 4/1994 | Van Deursen et al. |
| D346,426 | S | 4/1994 | Warshawsky |
| D346,428 | S | 4/1994 | Warshawsky |
| D346,430 | S | 4/1994 | Warshawsky |
| D347,262 | S | 5/1994 | Black et al. |
| D347,265 | S | 5/1994 | Gottwald |
| 5,316,216 | A | 5/1994 | Cammack et al. |
| D348,720 | S | 7/1994 | Haug et al. |
| 5,329,650 | A | 7/1994 | Zaccai et al. |
| D349,947 | S | 8/1994 | Hing-Wah |
| 5,333,787 | A | 8/1994 | Smith et al. |
| 5,333,789 | A | 8/1994 | Garneys |
| 5,340,064 | A | 8/1994 | Heimann et al. |
| 5,340,165 | A | 8/1994 | Sheppard |
| D350,808 | S | 9/1994 | Warshawsky |
| 5,344,080 | A | 9/1994 | Matsui |
| 5,349,987 | A | 9/1994 | Shieh |
| 5,356,076 | A | 10/1994 | Bishop |
| 5,356,077 | A | 10/1994 | Shames |
| D352,092 | S | 11/1994 | Warshawsky |
| D352,347 | S | 11/1994 | Dannenberg |
| D352,766 | S | 11/1994 | Hill et al. |
| 5,368,235 | A | 11/1994 | Drozdoff et al. |
| 5,369,556 | A | 11/1994 | Zeller |
| 5,370,427 | A | 12/1994 | Hoelle et al. |
| 5,385,500 | A | 1/1995 | Schmidt |
| D355,242 | S | 2/1995 | Warshawsky |
| D355,703 | S | 2/1995 | Duell |
| D356,626 | S | 3/1995 | Wang |
| 5,397,064 | A | 3/1995 | Heitzman |
| 5,398,872 | A | 3/1995 | Joubran |
| 5,398,977 | A | 3/1995 | Berger et al. |
| 5,402,812 | A | 4/1995 | Moineau et al. |
| 5,405,089 | A | 4/1995 | Heimann et al. |
| 5,414,879 | A | 5/1995 | Hiraishi et al. |
| 5,423,348 | A | 6/1995 | Jezek et al. |
| 5,433,384 | A | 7/1995 | Chan et al. |
| D361,399 | S | 8/1995 | Carbone et al. |
| D361,623 | S | 8/1995 | Huen |
| 5,441,075 | A | 8/1995 | Clare |
| 5,449,206 | A | 9/1995 | Lockwood |
| D363,360 | S | 10/1995 | Santarsiero |
| 5,454,809 | A | 10/1995 | Janssen |
| 5,468,057 | A | 11/1995 | Megerle et al. |
| D364,935 | S | 12/1995 | deBlois |
| D365,625 | S | 12/1995 | Bova |
| D365,646 | S | 12/1995 | deBlois |
| 5,476,225 | A | 12/1995 | Chan |
| D366,309 | S | 1/1996 | Huang |
| D366,707 | S | 1/1996 | Kaiser |
| D366,708 | S | 1/1996 | Santarsiero |
| D366,709 | S | 1/1996 | Szymanski |
| D366,710 | S | 1/1996 | Szymanski |
| 5,481,765 | A | 1/1996 | Wang |
| D366,948 | S | 2/1996 | Carbone |
| D367,315 | S | 2/1996 | Andrus |
| D367,333 | S | 2/1996 | Swyst |
| D367,696 | S | 3/1996 | Andrus |
| D367,934 | S | 3/1996 | Carbone |
| D368,146 | S | 3/1996 | Carbone |
| D368,317 | S | 3/1996 | Swyst |
| 5,499,767 | A | 3/1996 | Morand |
| D368,539 | S | 4/1996 | Carbone et al. |
| D368,540 | S | 4/1996 | Santarsiero |
| D368,541 | S | 4/1996 | Kaiser et al. |
| D368,542 | S | 4/1996 | deBlois et al. |
| D369,204 | S | 4/1996 | Andrus |
| D369,205 | S | 4/1996 | Andrus |
| 5,507,436 | A | 4/1996 | Ruttenberg |
| D369,873 | S | 5/1996 | deBlois et al. |
| D369,874 | S | 5/1996 | Santarsiero |
| D369,875 | S | 5/1996 | Carbone |

(56) References Cited

U.S. PATENT DOCUMENTS

D370,052 S 5/1996 Chan et al.
D370,250 S 5/1996 Fawcett et al.
D370,277 S 5/1996 Kaiser
D370,278 S 5/1996 Nolan
D370,279 S 5/1996 deBlois
D370,280 S 5/1996 Kaiser
D370,281 S 5/1996 Johnstone et al.
5,517,392 A 5/1996 Rousso et al.
5,521,803 A 5/1996 Eckert et al.
D370,542 S 6/1996 Santarsiero
D370,735 S 6/1996 deBlois
D370,987 S 6/1996 Santarsiero
D370,988 S 6/1996 Santarsiero
D371,448 S 7/1996 Santarsiero
D371,618 S 7/1996 Nolan
D371,619 S 7/1996 Szymanski
D371,856 S 7/1996 Carbone
D372,318 S 7/1996 Szymanski
D372,319 S 7/1996 Carbone
5,531,625 A 7/1996 Zhong
5,539,624 A 7/1996 Dougherty
D372,548 S 8/1996 Carbone
D372,998 S 8/1996 Carbone
D373,210 S 8/1996 Santarsiero
D373,434 S 9/1996 Nolan
D373,435 S 9/1996 Nolan
D373,645 S 9/1996 Johnstone et al.
D373,646 S 9/1996 Szymanski et al.
D373,647 S 9/1996 Kaiser
D373,648 S 9/1996 Kaiser
D373,649 S 9/1996 Carbone
D373,651 S 9/1996 Szymanski
D373,652 S 9/1996 Kaiser
5,551,637 A 9/1996 Lo
5,552,973 A 9/1996 Hsu
5,558,278 A 9/1996 Gallorini
D374,271 S 10/1996 Fleischmann
D374,297 S 10/1996 Kaiser
D374,298 S 10/1996 Swyst
D374,299 S 10/1996 Carbone
D374,493 S 10/1996 Szymanski
D374,494 S 10/1996 Santarsiero
D374,732 S 10/1996 Kaiser
D374,733 S 10/1996 Santasiero
5,560,548 A 10/1996 Mueller et al.
5,567,115 A 10/1996 Carbone
D375,541 S 11/1996 Michaluk
5,577,664 A 11/1996 Heitzman
D376,217 S 12/1996 Kaiser
D376,860 S 12/1996 Santarsiero
D376,861 S 12/1996 Johnstone et al.
D376,862 S 12/1996 Carbone
5,605,173 A 2/1997 Arnaud
D378,401 S 3/1997 Neufeld et al.
5,613,638 A 3/1997 Blessing
5,613,639 A 3/1997 Storm et al.
5,615,837 A 4/1997 Roman
5,624,074 A 4/1997 Parisi
5,624,498 A 4/1997 Lee et al.
D379,212 S 5/1997 Chan
D379,404 S 5/1997 Spelts
5,632,049 A 5/1997 Chen
D381,405 S 7/1997 Waidele et al.
D381,737 S 7/1997 Chan
D382,936 S 8/1997 Shfaram
5,653,260 A 8/1997 Huber
5,667,146 A 9/1997 Pimentel et al.
D385,332 S 10/1997 Andrus
D385,333 S 10/1997 Caroen et al.
D385,334 S 10/1997 Caroen et al.
D385,616 S 10/1997 Dow et al.
D385,947 S 11/1997 Dow et al.
D387,230 S 12/1997 von Buelow et al.
5,697,557 A 12/1997 Blessing et al.
5,699,964 A 12/1997 Bergmann et al.
5,702,057 A 12/1997 Huber
D389,558 S 1/1998 Andrus
5,704,080 A 1/1998 Kuhne
5,707,011 A 1/1998 Bosio
5,718,380 A 2/1998 Schorn et al.
D392,369 S 3/1998 Chan
5,730,361 A 3/1998 Thonnes
5,730,362 A 3/1998 Cordes
5,730,363 A 3/1998 Kress
5,742,961 A 4/1998 Casperson et al.
D394,490 S 5/1998 Andrus et al.
5,746,375 A 5/1998 Guo
5,749,552 A 5/1998 Fan
5,749,602 A 5/1998 Delaney et al.
D394,899 S 6/1998 Caroen et al.
D395,074 S 6/1998 Neibrook et al.
D395,142 S 6/1998 Neibrook
5,764,760 A 6/1998 Grandbert et al.
5,765,760 A 6/1998 Kuo
5,769,802 A 6/1998 Wang
5,772,120 A 6/1998 Huber
5,778,939 A 7/1998 Hok-Yin
5,788,157 A 8/1998 Kress
D398,370 S 9/1998 Purdy
5,806,771 A 9/1998 Loschelder et al.
5,819,791 A 10/1998 Chronister et al.
5,820,574 A 10/1998 Henkin et al.
5,823,431 A 10/1998 Pierce
5,823,442 A 10/1998 Guo
5,826,803 A 10/1998 Cooper
5,833,138 A 11/1998 Crane et al.
5,839,666 A 11/1998 Heimann et al.
D402,350 S 12/1998 Andrus
D403,754 S 1/1999 Gottwald
D404,116 S 1/1999 Bosio
5,855,348 A 1/1999 Fornara
5,860,599 A 1/1999 Lin
5,862,543 A 1/1999 Reynoso et al.
5,862,985 A 1/1999 Neibrook et al.
D405,502 S 2/1999 Tse
5,865,375 A 2/1999 Hsu
5,865,378 A 2/1999 Hollinshead et al.
5,873,647 A 2/1999 Kurtz et al.
D408,893 S 4/1999 Tse
D409,276 S 5/1999 Ratzlaff
D410,276 S 5/1999 Ben-Tsur
5,918,809 A 7/1999 Simmons
5,918,811 A 7/1999 Denham et al.
D413,157 S 8/1999 Ratzlaff
5,937,905 A 8/1999 Santos
5,938,123 A 8/1999 Heitzman
5,941,462 A 8/1999 Sandor
5,947,388 A 9/1999 Woodruff
D415,247 S 10/1999 Haverstraw et al.
5,961,046 A 10/1999 Joubran
5,967,417 A 10/1999 Mantel
5,979,776 A 11/1999 Williams
5,992,762 A 11/1999 Wang
D418,200 S 12/1999 Ben-Tsur
5,997,047 A 12/1999 Pimentel et al.
6,003,165 A 12/1999 Loyd
D418,902 S 1/2000 Haverstraw et al.
D418,903 S 1/2000 Haverstraw et al.
D418,904 S 1/2000 Milrud
D421,099 S 2/2000 Mullenmeister
6,021,960 A 2/2000 Kehat
D422,053 S 3/2000 Brenner et al.
6,042,027 A 3/2000 Sandvik
6,042,155 A 3/2000 Lockwood
D422,336 S 4/2000 Haverstraw et al.
D422,337 S 4/2000 Chan
D423,083 S 4/2000 Haug et al.
D423,110 S 4/2000 Cipkowski
D424,160 S 5/2000 Haug et al.
D424,161 S 5/2000 Haug et al.
D424,162 S 5/2000 Haug et al.
D424,163 S 5/2000 Haug et al.
D426,290 S 6/2000 Haug et al.
D427,661 S 7/2000 Haverstraw et al.

(56) References Cited

U.S. PATENT DOCUMENTS

D428,110 S 7/2000 Haug et al.
D428,125 S 7/2000 Chan
6,085,780 A 7/2000 Morris
D430,267 S 8/2000 Milrud et al.
6,095,801 A 8/2000 Spiewak
D430,643 S 9/2000 Tse
6,113,002 A 9/2000 Finkbeiner
6,123,272 A 9/2000 Havican et al.
6,123,308 A 9/2000 Faisst
D432,624 S 10/2000 Chan
D432,625 S 10/2000 Chan
D433,096 S 10/2000 Tse
D433,097 S 10/2000 Tse
6,126,091 A 10/2000 Heitzman
6,126,290 A * 10/2000 Veigel ..... 362/96
D434,109 S 11/2000 Ko
6,164,569 A 12/2000 Hollinshead et al.
6,164,570 A 12/2000 Smeltzer
D435,889 S 1/2001 Ben-Tsur et al.
D439,305 S 3/2001 Slothower
6,199,580 B1 3/2001 Morris
6,202,679 B1 3/2001 Titus
D440,276 S 4/2001 Slothower
D440,277 S 4/2001 Slothower
D440,278 S 4/2001 Slothower
D441,059 S 4/2001 Fleischmann
6,209,799 B1 4/2001 Finkbeiner
D443,025 S 5/2001 Kollmann et al.
D443,026 S 5/2001 Kollmann et al.
D443,027 S 5/2001 Kollmann et al.
D443,029 S 5/2001 Kollmann et al.
6,223,998 B1 5/2001 Heitzman
6,230,984 B1 5/2001 Jager
6,230,988 B1 5/2001 Chao
6,230,989 B1 5/2001 Haverstraw et al.
D443,335 S 6/2001 Andrus
D443,336 S 6/2001 Kollmann et al.
D443,347 S 6/2001 Gottwald
6,241,166 B1 6/2001 Overington et al.
6,250,572 B1 6/2001 Chen
D444,865 S 7/2001 Gottwald
D445,871 S 7/2001 Fan
6,254,014 B1 7/2001 Clearman et al.
6,270,278 B1 8/2001 Mauro
6,276,004 B1 8/2001 Bertrand et al.
6,283,447 B1 9/2001 Fleet
6,286,764 B1 9/2001 Garvey et al.
D449,673 S 10/2001 Kollmann et al.
D450,370 S 11/2001 Wales et al.
D450,805 S 11/2001 Lindholm et al.
D450,806 S 11/2001 Lindholm et al.
D450,807 S 11/2001 Lindholm et al.
D451,169 S 11/2001 Lindholm et al.
D451,170 S 11/2001 Lindholm et al.
D451,171 S 11/2001 Lindholm et al.
D451,172 S 11/2001 Lindholm et al.
6,321,777 B1 11/2001 Wu
6,322,006 B1 11/2001 Guo
D451,583 S 12/2001 Lindholm et al.
D451,980 S 12/2001 Lindholm et al.
D452,553 S 12/2001 Lindholm et al.
D452,725 S 1/2002 Lindholm et al.
D452,897 S 1/2002 Gillette et al.
6,336,764 B1 1/2002 Liu
D453,369 S 2/2002 Lobermeier
D453,370 S 2/2002 Lindholm et al.
D453,551 S 2/2002 Lindholm et al.
6,349,735 B2 2/2002 Gul
D454,617 S 3/2002 Curbbun et al.
D454,938 S 3/2002 Lord
6,375,342 B1 4/2002 Koren et al.
D457,937 S 5/2002 Lindholm et al.
6,382,531 B1 5/2002 Tracy
D458,348 S 6/2002 Mullenmeister
6,412,711 B1 7/2002 Fan
D461,224 S 8/2002 Lobermeier
D461,878 S 8/2002 Green et al.
6,450,425 B1 9/2002 Chen
6,454,186 B2 9/2002 Haverstraw et al.
6,463,658 B1 10/2002 Larsson
6,464,265 B1 10/2002 Mikol
D465,552 S 11/2002 Tse
D465,553 S 11/2002 Singtoroj
6,484,952 B2 11/2002 Koren
D468,800 S 1/2003 Tse
D469,165 S 1/2003 Lim
6,502,796 B1 1/2003 Wales
6,508,415 B2 1/2003 Wang
6,511,001 B1 1/2003 Huang
D470,219 S 2/2003 Schweitzer
6,516,070 B2 2/2003 Macey
D471,253 S 3/2003 Tse
D471,953 S 3/2003 Colligan et al.
6,533,194 B2 3/2003 Marsh et al.
6,537,455 B2 3/2003 Farley
D472,958 S 4/2003 Ouyoung
6,550,697 B2 4/2003 Lai
6,585,174 B1 7/2003 Huang
6,595,439 B1 7/2003 Chen
6,607,148 B1 8/2003 Marsh et al.
6,611,971 B1 9/2003 Antoniello et al.
6,637,676 B2 10/2003 Zieger et al.
6,641,057 B2 * 11/2003 Thomas et al. ..... 239/104
D483,837 S 12/2003 Fan
6,659,117 B2 12/2003 Gilmore
6,659,372 B2 12/2003 Marsh et al.
D485,887 S 1/2004 Luettgen et al.
D486,888 S 2/2004 Lobermeier
6,691,338 B2 2/2004 Zieger
6,691,933 B1 2/2004 Bosio
D487,301 S 3/2004 Haug et al.
D487,498 S 3/2004 Blomstrom
6,701,953 B2 3/2004 Agosta
6,715,699 B1 4/2004 Greenberg et al.
6,719,218 B2 4/2004 Cool et al.
D489,798 S 5/2004 Hunt
D490,498 S 5/2004 Golichowski
6,736,336 B2 5/2004 Wong
6,739,523 B2 5/2004 Haverstraw et al.
6,739,527 B1 5/2004 Chung
D492,004 S 6/2004 Haug et al.
D492,007 S 6/2004 Kollmann et al.
6,742,725 B1 6/2004 Fan
D493,208 S 7/2004 Lin
D493,864 S 8/2004 Haug et al.
D494,655 S 8/2004 Lin
D494,661 S 8/2004 Zieger et al.
D495,027 S 8/2004 Mazzola
6,776,357 B1 8/2004 Naito
6,789,751 B1 9/2004 Fan
D496,987 S 10/2004 Glunk
D497,974 S 11/2004 Haug et al.
D498,514 S 11/2004 Haug et al.
D500,121 S 12/2004 Blomstrom
D500,549 S 1/2005 Blomstrom
D501,242 S 1/2005 Blomstrom
D502,760 S 3/2005 Zieger et al.
D502,761 S 3/2005 Zieger et al.
D503,211 S 3/2005 Lin
6,863,227 B2 3/2005 Wollenberg et al.
6,869,030 B2 3/2005 Blessing et al.
D503,774 S 4/2005 Zieger
D503,775 S 4/2005 Zieger
D503,966 S 4/2005 Zieger
6,899,292 B2 5/2005 Titinet
D506,243 S 6/2005 Wu
D507,037 S 7/2005 Wu
6,935,581 B2 8/2005 Titinet
D509,280 S 9/2005 Bailey et al.
D509,563 S 9/2005 Bailey et al.
D510,123 S 9/2005 Tsai
D511,809 S 11/2005 Haug et al.
D512,119 S 11/2005 Haug et al.
6,981,661 B1 1/2006 Chen

(56) References Cited

U.S. PATENT DOCUMENTS

| | | | |
|---|---|---|---|
| D516,169 | S | 2/2006 | Wu |
| 7,000,854 | B2 | 2/2006 | Malek et al. |
| 7,004,409 | B2 | 2/2006 | Okubo |
| 7,004,410 | B2 | 2/2006 | Li |
| D520,109 | S | 5/2006 | Wu |
| 7,040,554 | B2 | 5/2006 | Drennow |
| 7,048,210 | B2 | 5/2006 | Clark |
| 7,055,767 | B1 | 6/2006 | Ko |
| 7,070,125 | B2 | 7/2006 | Williams et al. |
| 7,077,342 | B2 | 7/2006 | Lee |
| D527,440 | S | 8/2006 | Macan |
| 7,093,780 | B1 | 8/2006 | Chung |
| 7,097,122 | B1 | 8/2006 | Farley |
| D528,631 | S | 9/2006 | Gillette et al. |
| 7,100,845 | B1 | 9/2006 | Hsieh |
| 7,111,795 | B2 | 9/2006 | Thong |
| 7,111,798 | B2 | 9/2006 | Thomas et al. |
| D530,389 | S | 10/2006 | Genslak et al. |
| D530,392 | S | 10/2006 | Tse |
| D531,259 | S | 10/2006 | Hsieh |
| 7,114,666 | B2 | 10/2006 | Luettgen et al. |
| D533,253 | S | 12/2006 | Luettgen et al. |
| D534,239 | S | 12/2006 | Dingler et al. |
| D535,354 | S | 1/2007 | Wu |
| D536,060 | S | 1/2007 | Sadler |
| 7,156,325 | B1 | 1/2007 | Chen |
| D538,391 | S | 3/2007 | Mazzola |
| D540,424 | S | 4/2007 | Kirar |
| D540,425 | S | 4/2007 | Endo et al. |
| D540,426 | S | 4/2007 | Cropelli |
| D540,427 | S | 4/2007 | Bouroullec et al. |
| D542,391 | S | 5/2007 | Gilbert |
| D542,393 | S | 5/2007 | Haug et al. |
| 7,229,031 | B2 | 6/2007 | Schmidt |
| 7,243,863 | B2 | 7/2007 | Glunk |
| 7,246,760 | B2 | 7/2007 | Marty et al. |
| D552,713 | S | 10/2007 | Rexach |
| 7,278,591 | B2 | 10/2007 | Clearman et al. |
| D556,295 | S | 11/2007 | Genord et al. |
| 7,299,510 | B2 | 11/2007 | Tsai |
| D557,763 | S | 12/2007 | Schonherr et al. |
| D557,764 | S | 12/2007 | Schonherr et al. |
| D557,765 | S | 12/2007 | Schonherr et al. |
| D558,301 | S | 12/2007 | Hoernig et al. |
| 7,303,151 | B2 | 12/2007 | Wu |
| D559,357 | S | 1/2008 | Wang et al. |
| D559,945 | S | 1/2008 | Patterson et al. |
| D560,269 | S | 1/2008 | Tse |
| D562,937 | S | 2/2008 | Schonherr et al. |
| D562,938 | S | 2/2008 | Blessing |
| D562,941 | S | 2/2008 | Pan |
| 7,331,536 | B1 | 2/2008 | Zhen et al. |
| 7,347,388 | B2 | 3/2008 | Chung |
| D565,699 | S | 4/2008 | Berberet |
| D565,702 | S | 4/2008 | Daunter et al. |
| D565,703 | S | 4/2008 | Lammel et al. |
| D566,228 | S | 4/2008 | Neagoe |
| D566,229 | S | 4/2008 | Rexach |
| D567,328 | S | 4/2008 | Spangler et al. |
| 7,360,723 | B2 | 4/2008 | Lev |
| 7,364,097 | B2 | 4/2008 | Okuma |
| 7,374,112 | B1 | 5/2008 | Bulan et al. |
| 7,384,007 | B2 | 6/2008 | Ho |
| D577,099 | S | 9/2008 | Leber |
| D577,793 | S | 9/2008 | Leber |
| D580,012 | S | 11/2008 | Quinn et al. |
| D580,513 | S | 11/2008 | Quinn et al. |
| D581,013 | S | 11/2008 | Citterio |
| D581,014 | S | 11/2008 | Quinn et al. |
| 7,503,345 | B2 | 3/2009 | Paterson et al. |
| D590,048 | S | 4/2009 | Leber et al. |
| 7,520,448 | B2 | 4/2009 | Luettgen et al. |
| D592,276 | S | 5/2009 | Schoenherr et al. |
| D592,278 | S | 5/2009 | Leber |
| 7,537,175 | B2 | 5/2009 | Miura et al. |
| D600,777 | S | 9/2009 | Whitaker et al. |
| D603,935 | S | 11/2009 | Leber |
| 7,617,990 | B2 | 11/2009 | Huffman |
| D605,731 | S | 12/2009 | Leber |
| D606,623 | S | 12/2009 | Whitaker et al. |
| D608,412 | S | 1/2010 | Barnard et al. |
| D608,413 | S | 1/2010 | Barnard et al. |
| D616,061 | S | 5/2010 | Whitaker et al. |
| 7,721,979 | B2 | 5/2010 | Mazzola |
| 7,740,186 | B2 | 6/2010 | Macan et al. |
| D621,904 | S | 8/2010 | Yoo et al. |
| D621,905 | S | 8/2010 | Yoo et al. |
| 7,770,820 | B2 | 8/2010 | Clearman et al. |
| 7,770,822 | B2 | 8/2010 | Leber |
| D624,156 | S | 9/2010 | Leber |
| 7,789,326 | B2 | 9/2010 | Luettgen et al. |
| D625,776 | S | 10/2010 | Williams |
| 7,832,662 | B2 | 11/2010 | Gallo |
| D628,676 | S | 12/2010 | Lee |
| D629,867 | S | 12/2010 | Rexach et al. |
| 2002/0109023 | A1 | 8/2002 | Thomas et al. |
| 2003/0062426 | A1 | 4/2003 | Gregory et al. |
| 2003/0121993 | A1* | 7/2003 | Haverstraw et al. ..... 239/443 |
| 2004/0074993 | A1 | 4/2004 | Thomas et al. |
| 2004/0118949 | A1 | 6/2004 | Marks |
| 2004/0217209 | A1 | 11/2004 | Bui |
| 2004/0244105 | A1 | 12/2004 | Tsai |
| 2005/0001072 | A1 | 1/2005 | Bolus et al. |
| 2005/0284967 | A1 | 12/2005 | Korb et al. |
| 2006/0016908 | A1 | 1/2006 | Chung |
| 2006/0016913 | A1 | 1/2006 | Lo |
| 2006/0102747 | A1 | 5/2006 | Ho |
| 2006/0163391 | A1 | 7/2006 | Schorn |
| 2006/0219822 | A1 | 10/2006 | Miller et al. |
| 2007/0040054 | A1 | 2/2007 | Farzan |
| 2007/0200013 | A1 | 8/2007 | Hsiao |
| 2007/0246577 | A1 | 10/2007 | Leber |
| 2007/0252021 | A1 | 11/2007 | Cristina |
| 2007/0272770 | A1 | 11/2007 | Leber et al. |
| 2008/0073449 | A1 | 3/2008 | Haynes et al. |
| 2008/0083844 | A1 | 4/2008 | Leber et al. |
| 2008/0121293 | A1* | 5/2008 | Leber et al. ..... 137/597 |
| 2008/0156897 | A1 | 7/2008 | Leber |
| 2008/0223957 | A1 | 9/2008 | Schorn |
| 2008/0272203 | A1 | 11/2008 | Leber |
| 2008/0272591 | A1 | 11/2008 | Leber |
| 2009/0200404 | A1 | 8/2009 | Cristina |
| 2009/0218420 | A1 | 9/2009 | Mazzola |
| 2009/0307836 | A1 | 12/2009 | Blattner et al. |
| 2009/0314858 | A1 | 12/2009 | Luettgen et al. |
| 2010/0065665 | A1 | 3/2010 | Whitaker |
| 2010/0127096 | A1 | 5/2010 | Leber |
| 2010/0193610 | A1 | 8/2010 | Leber et al. |
| 2010/0320290 | A1 | 12/2010 | Luettgen et al. |
| 2011/0000982 | A1 | 1/2011 | Luettgen et al. |
| 2011/0000983 | A1 | 1/2011 | Chang |
| 2011/0011953 | A1 | 1/2011 | Macan et al. |

FOREIGN PATENT DOCUMENTS

| | | |
|---|---|---|
| CH | 234284 | 3/1963 |
| DE | 352813 | 5/1922 |
| DE | 848627 | 9/1952 |
| DE | 854100 | 10/1952 |
| DE | 2360534 | 6/1974 |
| DE | 2806093 | 8/1979 |
| DE | 3107808 | 9/1982 |
| DE | 3246327 | 6/1984 |
| DE | 3440901 | 7/1985 |
| DE | 3706320 | 3/1988 |
| DE | 8804236 | 6/1988 |
| DE | 4034695 | 5/1991 |
| DE | 19608085 | 9/1996 |
| DE | 202005000881 | 3/2005 |
| DE | 102006032017 | 1/2008 |
| EP | 0167063 | 6/1985 |
| EP | 0478999 | 4/1992 |
| EP | 0514753 | 11/1992 |
| EP | 0435030 | 7/1993 |

(56) References Cited

FOREIGN PATENT DOCUMENTS

| | | |
|---|---|---|
| EP | 0617644 | 10/1994 |
| EP | 0683354 | 11/1995 |
| EP | 0687851 | 12/1995 |
| EP | 0695907 | 2/1996 |
| EP | 0700729 | 3/1996 |
| EP | 0719588 | 7/1996 |
| EP | 0721082 | 7/1996 |
| EP | 0733747 | 9/1996 |
| EP | 0808661 | 11/1997 |
| EP | 0726811 | 1/1998 |
| EP | 2164642 | 10/2010 |
| EP | 2260945 | 12/2010 |
| FR | 538538 | 6/1922 |
| FR | 873808 | 7/1942 |
| FR | 1039750 | 10/1953 |
| FR | 1098836 | 8/1955 |
| FR | 2596492 | 10/1987 |
| FR | 2695452 | 3/1994 |
| GB | 3314 | 0/1914 |
| GB | 10086 | 0/1894 |
| GB | 129812 | 7/1919 |
| GB | 204600 | 10/1923 |
| GB | 634483 | 3/1950 |
| GB | 971866 | 10/1964 |
| GB | 1111126 | 4/1968 |
| GB | 2066074 | 1/1980 |
| GB | 2066704 | 7/1981 |
| GB | 2068778 | 8/1981 |
| GB | 2121319 | 12/1983 |
| GB | 2155984 | 10/1985 |
| GB | 2156932 A | 10/1985 |
| GB | 2199771 | 7/1988 |
| GB | 2298595 | 11/1996 |
| GB | 2337471 | 11/1999 |
| IT | 327400 | 7/1935 |
| IT | 350359 | 7/1937 |
| IT | 563459 | 5/1957 |
| JP | S63-181459 | 11/1988 |
| JP | H2-78660 | 6/1990 |
| JP | 4062238 | 2/1992 |
| JP | 4146708 | 5/1992 |
| NL | 8902957 | 6/1991 |
| WO | WO93/12894 | 7/1993 |
| WO | WO93/25839 | 12/1993 |
| WO | WO96/00617 | 1/1996 |
| WO | WO98/30336 | 7/1998 |
| WO | WO99/59726 | 11/1999 |
| WO | WO00/10720 | 3/2000 |
| WO | WO2010/004593 | 1/2010 |

OTHER PUBLICATIONS

Color Copy, Labeled 1A, Gemlo, available at least as early as Dec. 2, 1998.

Color Copy, Labeled 1B, Gemlo, available at least as early as Dec. 2, 1998.

* cited by examiner

MODE CONTROL VALVE IN SHOWERHEAD CONNECTOR

FIELD OF TECHNOLOGY

The present invention generally relates to a showerhead and, more particularly, to a showerhead including a mode control valve to operate a variety of spray modes.

BACKGROUND

With an increase in the popularity of showers, the demand for showerhead assemblies has also increased. Over the years, many designs for showerhead assemblies have been developed. For example, some designs include mode selectors that allow a user to actuate a control knob or lever to transition from a first spray mode to a second spray mode. Other showerhead assemblies include an adjusting device that allows a user to reposition a shower arm relative to a connecting water pipe.

The information included in this Background section of the specification, including any references cited herein and any description or discussion thereof, is included for technical reference purposes only and is not to be regarded subject matter by which the scope of the invention is to be bound.

SUMMARY

The technology disclosed herein pertains generally to the enhancement of the effectiveness of a showerhead. In particular, an exemplary showerhead may include a body having an arm structure, a spray head formed at a distal end of the arm structure, a mode selector, a number of fluid conduits connecting the mode selector to the spray head, and a connection structure housing an adjustment mechanism. The connection structure is configured for connection with a water pipe to supply water to the mode selector. The mode selector may be coupled to the plurality of fluid conduits that may supply water to separate spray modes for the spray head. The mode selector may be configured to transition between multiple settings to direct water flow from a first chamber to one or more receiving chambers positioned below the first chamber that are further connected to respective fluid conduits.

Another embodiment may take the form of a showerhead including an arm structure, a spray head, a connection structure adapted to couple to a water pipe to receive water flow therefrom, a first fluid conduit, a second fluid conduit, and a mode selector. The mode selector may be housed within the connection structure and operably coupled with the first fluid conduit and the second fluid conduit. The mode selector may be configured to transition between a first setting to direct water flow from a first chamber to a second chamber positioned below the first chamber and a second setting to direct water flow from the first chamber to a third chamber positioned below the first chamber. The second chamber may be in fluid communication with the first fluid conduit and the third chamber may be in fluid communication with the second fluid conduit. The spray head may be configured to receive and distribute the water flow from the first and second fluid conduits.

In certain embodiments, the mode selector may be positioned in a base of the arm structure. The spray head may include a first plurality of nozzles operatively coupled to the first fluid conduit and a second plurality of nozzles operatively coupled to the second fluid conduit. In another embodiment, the base of the arm structure may be configured to be pivotally coupled relative to the water pipe.

In another embodiment, the mode selector may include a distributor spool configured to rotate between first and second positions corresponding to the mode selector settings. In a further embodiment, the distributor spool may include a valve seal positioned below the first chamber and above the second and third chambers. In another embodiment of the showerhead, the mode selector is further configured to transition between the second setting and a third setting to direct water flow from the first chamber to a fourth chamber positioned below the first chamber. The fourth chamber may be in fluid communication with a third fluid conduit. In some embodiments, the fluid conduits may be hoses contained within the arm structure.

Another embodiment of a showerhead may include a base portion configured for coupling to a water pipe and operative to receive water flow therefrom. The base portion may be connected to a spray head portion via an arm portion operative to receive the water flow from the base portion and distribute the water flow to a user. A plurality of fluid conduits may be coupled to and between the base portion and the spray head portion and extend through the arm portion. The fluid conduits transport the water flow to the spray head portion. A mode selector may be operatively coupled to the fluid conduits. The mode selector may be configured to receive the water flow from the water pipe in a first chamber and selectively direct the water flow to a multiple chambers positioned below the first chamber. Each of the fluid conduits may be in fluid communication with a respective one of the fluid chambers.

Another embodiment may take the form of a showerhead system including a head portion configured to receive water flow to distribute to a user and a support structure coupled to the head portion and configured to receive and transport water flow to the head portion. The support structure may include a plurality of fluid conduits connected to the spray head portion, and a mode selector operatively coupled to the fluid conduits to transport water flow from the mode selector to the spray head portion. The mode selector may be configured to transition between a first setting associated with a first chamber defined within the mode selector and a second setting associated with a second chamber defined within the mode selector. The first chamber may be associated with the first fluid conduit and the second chamber may be associated with the second fluid conduit.

This Summary is provided to introduce a selection of concepts in a simplified form that are further described below in the Detailed Description. This Summary is not intended to identify key features or essential features of the claimed subject matter, nor is it intended to be used to limit the scope of the claimed subject matter. Other features, details, utilities, and advantages of the present invention will be apparent from the following more particular written description of various embodiments of the invention as further illustrated in the accompanying drawings and defined in the appended claims.

BRIEF DESCRIPTION OF THE DRAWINGS

The drawings described herein are for illustration purposes only and are not intended to limit the scope of the present disclosure in any way.

DETAILED DESCRIPTION

Figure 1:
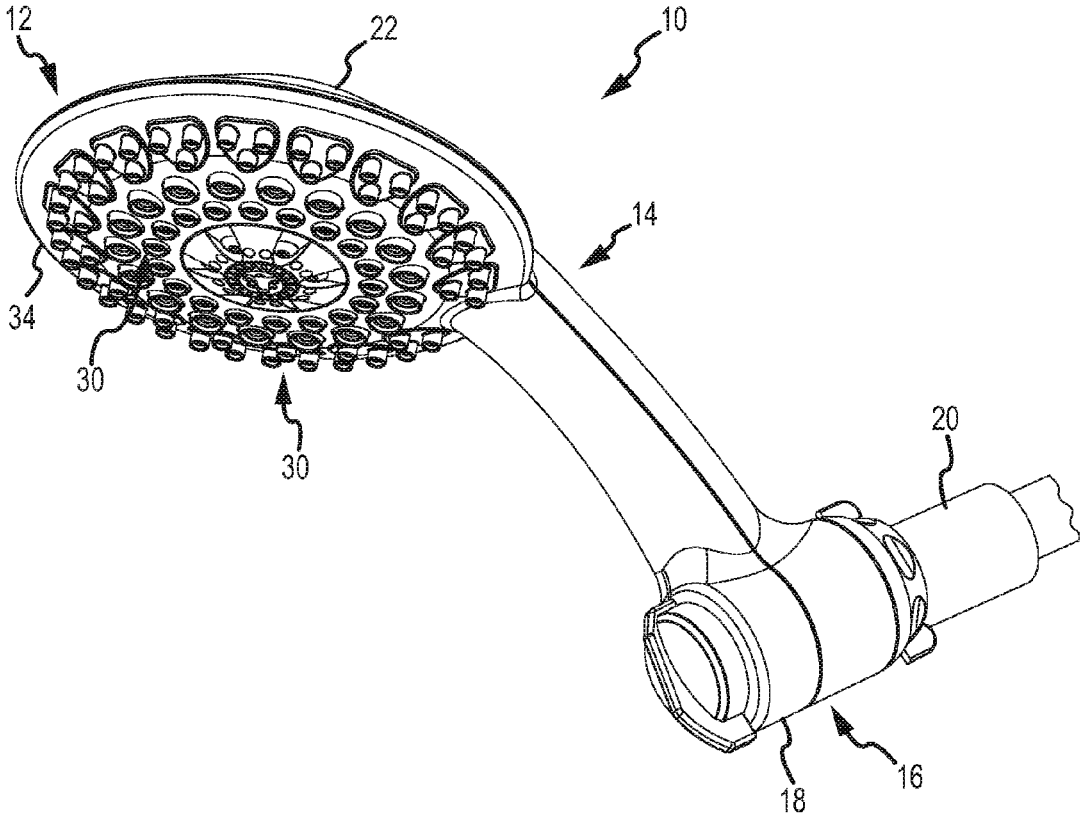
FIG. 1 is an isometric view of an exemplary showerhead.

An exemplary showerhead is generally indicated by reference numeral 10 in the drawings. The exemplary showerhead may include a body having an arm or other support structure and a connection structure with an adjustment mechanism located adjacent to the water pipe, and a mode selector. The mode selector may be coupled to a plurality of water conduits that may provide separate spray modes for the showerhead. The mode selector may be configured to transition between multiple settings to direct water flow from a first chamber to a plurality of receiving chambers positioned below the first chamber. The receiving chambers may each be configured to direct the water flow to a separate, respective fluid conduit. The mode selector may also include a distributor spool and a movable valve seal that is positioned between the first chamber and the receiving chambers.

Figure 2:
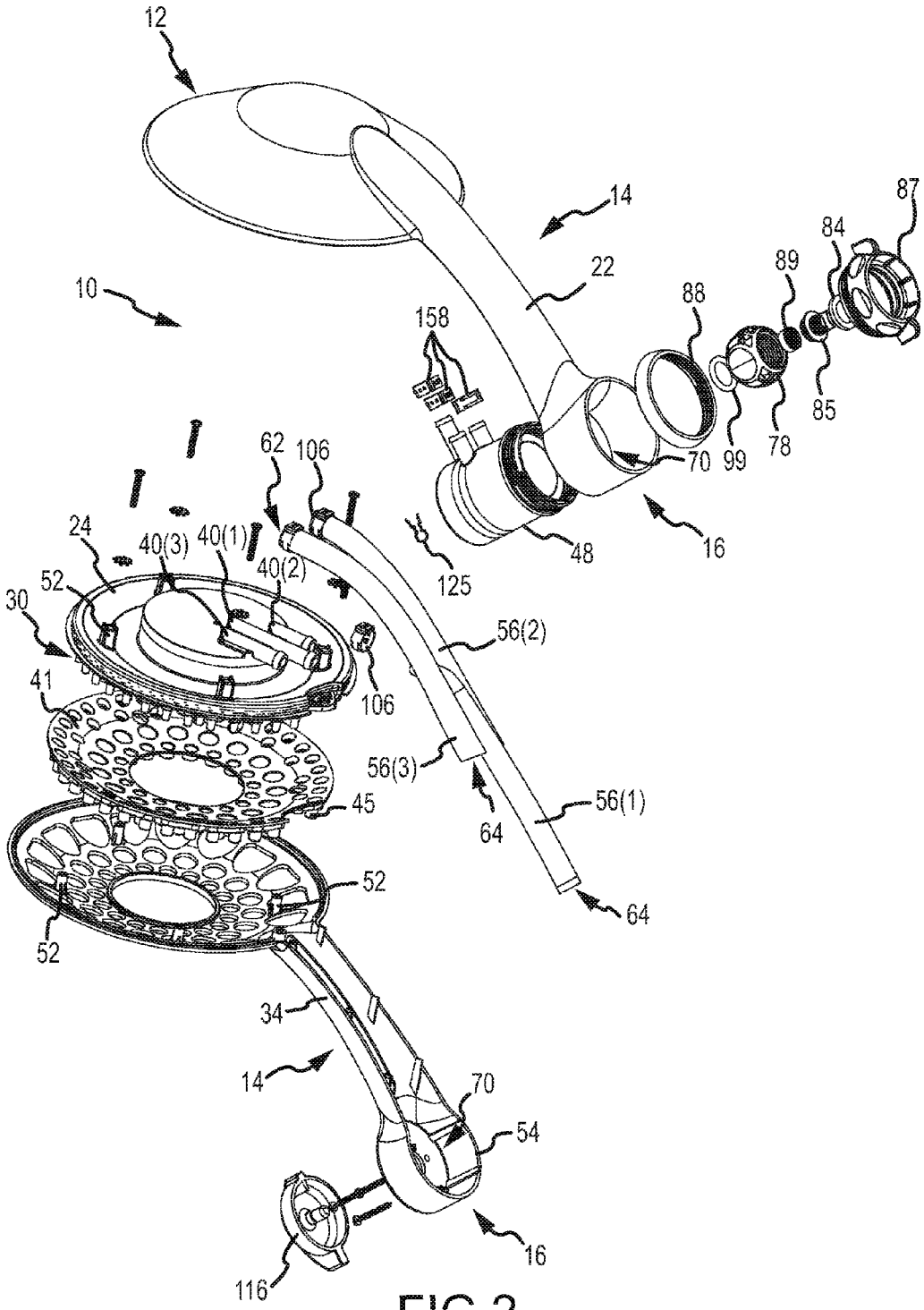
FIG. 2 is an exploded view of the showerhead in FIG. 1.

As shown in FIGS. 1 and 2, one embodiment of the shower arm 10 may include an upper housing portion 22 and a lower housing portion 34. The upper and lower housing portions 22, 34 may be coupled together to define a spray head portion 12, an arm structure 14, and a connection structure 16. The arm structure 14 and the connection structure 16 together support the spray head 12. The connection structure 16 may be coupled to a water pipe 20 to receive water flow from the water pipe 20. The spray head 12 is configured to receive the water flow from the arm structure 14 to distribute to a user.

The upper and lower housing portions 22, 34 may be molded from a lightweight polymeric material, such as plastic, or more specifically an acrylonitrile butadiene styrene (ABS) plastic, or any suitable thermoplastic known to those in the art. The upper housing portion 22 and the lower housing portion 34 may each comprise a single molded piece, as shown in FIGS. 1 and 2 or, in other embodiments, may be made from a plurality of molded pieces adapted to fit together.

In one embodiment, the interior of the upper housing portion 22 may include a plurality of female alignment features (not shown) and the interior of the lower housing portion 34 may include a plurality of corresponding male alignment features 52 that are configured to fit into the female alignment features of the upper housing portion 22. The alignment features may facilitate alignment of the upper and lower housing portions 22, 34 when the shower arm 10 is assembled. To hold the upper and lower housing portions 22, 34 together, the housing portions 22, 34 may be bonded together by an adhesive that may applied to the edges of the upper and lower housing portions 22, 34, or alternatively, the housing portions 22, 34 may be ultrasonically welded together. The upper and lower housing portions 22, 34 may be held together using any known joining mechanism, including a variety of adhesives, welds, and/or fasteners.

Still referring to FIGS. 1 and 2, the head portion 12 may be circular or any other desired shape, and may include a head assembly 24 having a plurality of nozzles 30 of varying configurations for multiple shower modes. The head assembly 24 may include any conventional head assembly that is configured to receive a water flow from multiple inlet conduits or channels and distribute it to a user in one of a plurality of different spray modes. The plurality of nozzles 30 may include different configurations for distributing the water flow to a user in various spray modes, patterns, and/or pressures.

In one embodiment, the head assembly 24 may include one or more fluid inlet ports 40(1, 2, 3) to receive the water flow from respective fluid conduits housed within the arm structure 14. Each of the inlet ports 40(1, 2, 3) directs the water flow through a water pathway to a specific set of nozzles 30 for distribution in a specific spray mode or configuration. For example, the head assembly 24 depicted in FIG. 2 provides three fluid inlet ports 40 that may receive and direct the water flow to three different sets of nozzles 30. The nozzles 30 may be molded from a lightweight polymeric material, such as plastic, or from metal or rubber.

The head portion 12 may further include a nozzle protection layer 41 including a plurality of nozzle covers 45 configured to receive the nozzles 30 of the head assembly 24. When the nozzles 30 are inserted into their respective nozzle covers 45, the nozzle covers 45 may cover all or part of the outer surface of the nozzles 30 and act as a protective layer to prevent buildup from forming on the nozzles 30, for example, due to hard water or bacteria. To this end, the nozzle protection layer 41 may be formed from a material that is both durable, resists bacteria and corrosion, and is easy to clean. For example, the nozzle protection layer 41 may be formed from an elastomer-based material such as rubber.

The arm structure 14 is coupled at a first end to the head portion 12 and at a second end to the connection portion 16. The connection portion 16 may be configured to house a mode selector 48. In one embodiment, the arm structure 14 may be configured to maintain and hold the head portion 12 in a fixed position relative to the connection portion 16. For example, the arm structure 14 may form a rigid stem that extends between the head portion 12 and the base portion 54, and may be configured to allow a user to grip the shower arm 10. The arm structure 14 may be straight, curved, or any suitable shape.

In other embodiments, the arm structure 14 may include indentations, knurling, or have an exterior surface covered with an elastomer-based material or provide other surface features to facilitate gripping of the shower arm 10 by the user.

As shown in FIG. 2, the arm structure 14 may include a number of fluid conduits 56(1, 2, 3) that are configured to transport the received water flow to a corresponding number of fluid inlet ports 40(1, 2, 3) of the head assembly 24. The arm structure 14 may include any number of fluid conduits 56(1, 2, 3). For example, in the embodiment depicted in the figures, the arm structure 14 may house three fluid conduits 56(1, 2, 3). In one embodiment, the fluid conduits 56(1, 2, 3) may be flexible hoses. In other embodiments, the fluid conduits may be formed by conduits in the upper and lower housing portions 22, 34 that are molded and/or welded together. As best shown in FIG. 2, a first end 62 of each of the fluid conduits 56(1, 2, 3) may be coupled to respective fluid inlet ports 40(1, 2, 3) of the head assembly 24 with clamps 106. A second end 64 of each of the fluid conduits 56(1, 2, 3) may be coupled to respective fluid outlet ports 156(1, 2, 3) on the mode selector 48 and secured with clamps 158.

As discussed above, the second end of the arm structure 14 may form the base portion 54. In one embodiment, the base portion 54 may have a circular configuration; however, the base portion may be formed as any suitable shape. The base portion 54 also defines a chamber 70 in which the mode selector 48 resides. The mode selector 48 may reside in the chamber 70 and direct the water flow to one or more of the fluid conduits 56(1, 2, 3) for transport to the head assembly 24.

Figure 3:
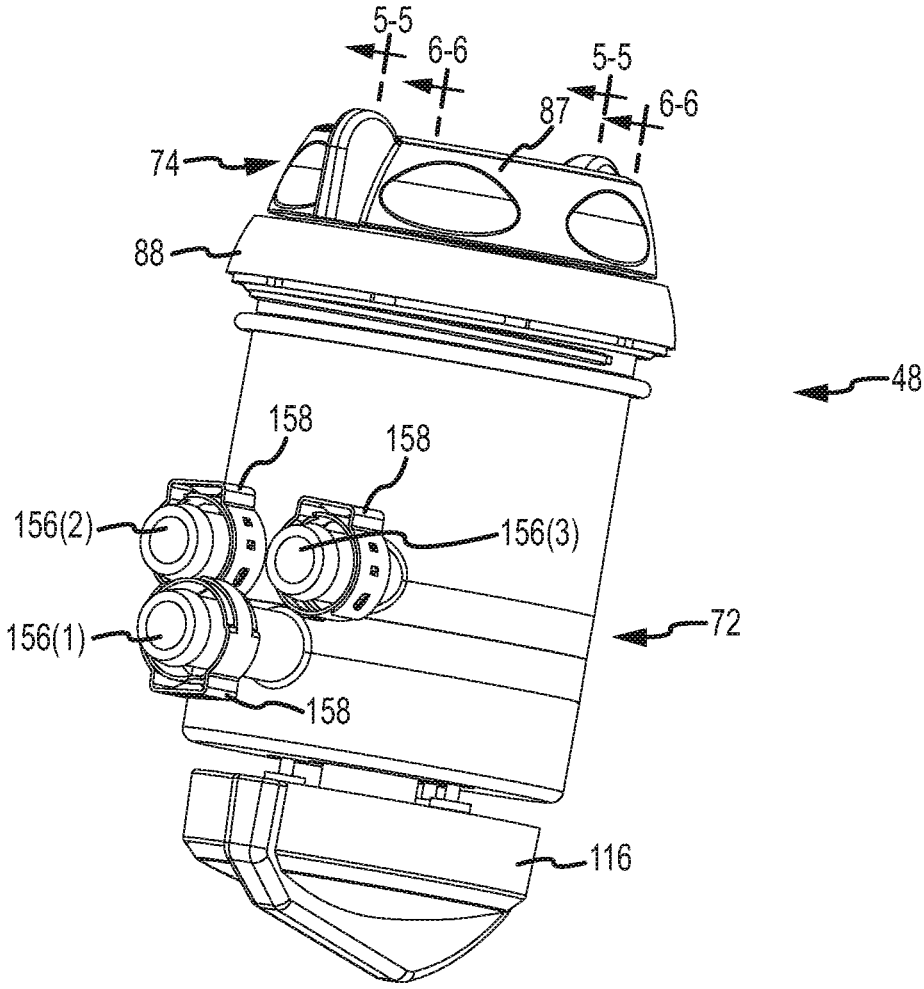
FIG. 3 is an isometric view of a mode selector of the showerhead of FIG. 1.

As shown in FIG. 3, the mode selector 48 may include a fluid distribution assembly 72 and an attachment structure 74. The fluid distribution assembly 72 may be coupled to the attachment structure 74. The attachment structure 74 may, in turn, be coupled to the water pipe 20 (see FIG. 1). Additionally, the mode selector 48 may include a control knob 116 for allowing a user to select various modes of operation.

Figure 4:
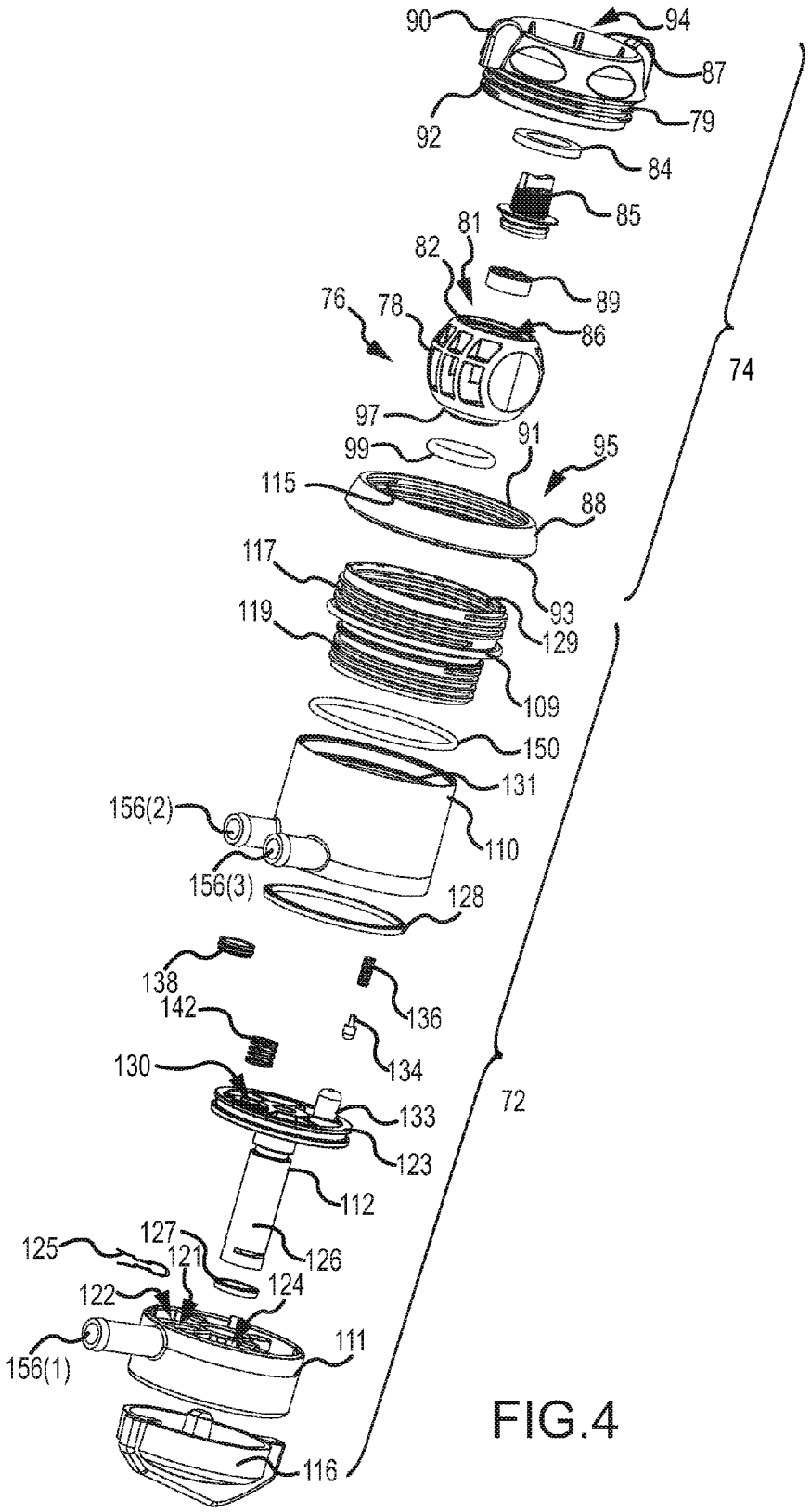
FIG. 4 is an exploded view of the mode selector shown in FIG. 3.

Now referring to FIG. 4, the attachment structure 74 may include a pivot ball unit 76 that includes a generally spherical ball 78 defining a passage 86 and including a coupling portion 81 that may couple the pivot ball unit 76 to the water pipe. In one embodiment, the coupling portion 81 may include a first threaded inner surface 82 in part of the passage 86 configured to fixedly couple with the water pipe 20, while allowing the shower arm 20 to pivot on the ball 78 of the pivot ball unit 76. When the first threaded inner surface 82 of the pivot ball unit 76 is screwed onto the water pipe 20, the ball 78 receives the water flow from the water pipe 20 and directs the water flow through the passage 86 that extends along an axis of the pivot ball unit 76.

Figure 5:
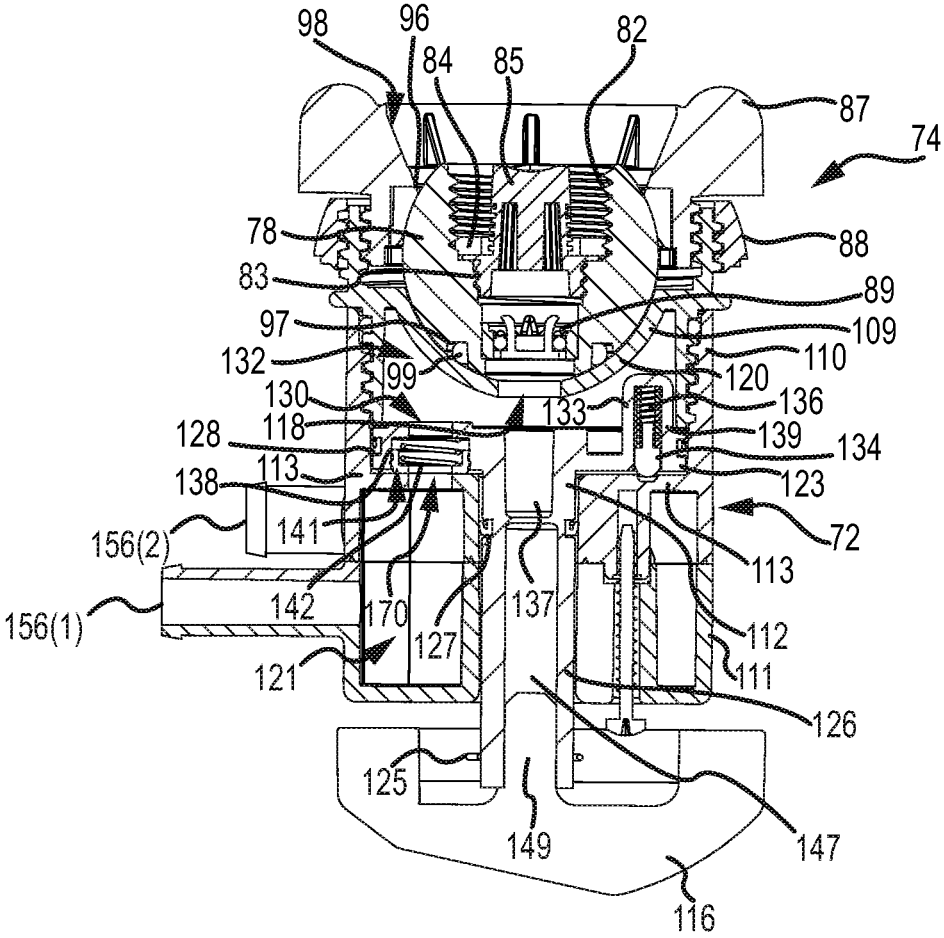
FIG. 5 is an elevation view in cross section of the mode selector along line 5-5 of FIG. 3.
Figure 6:
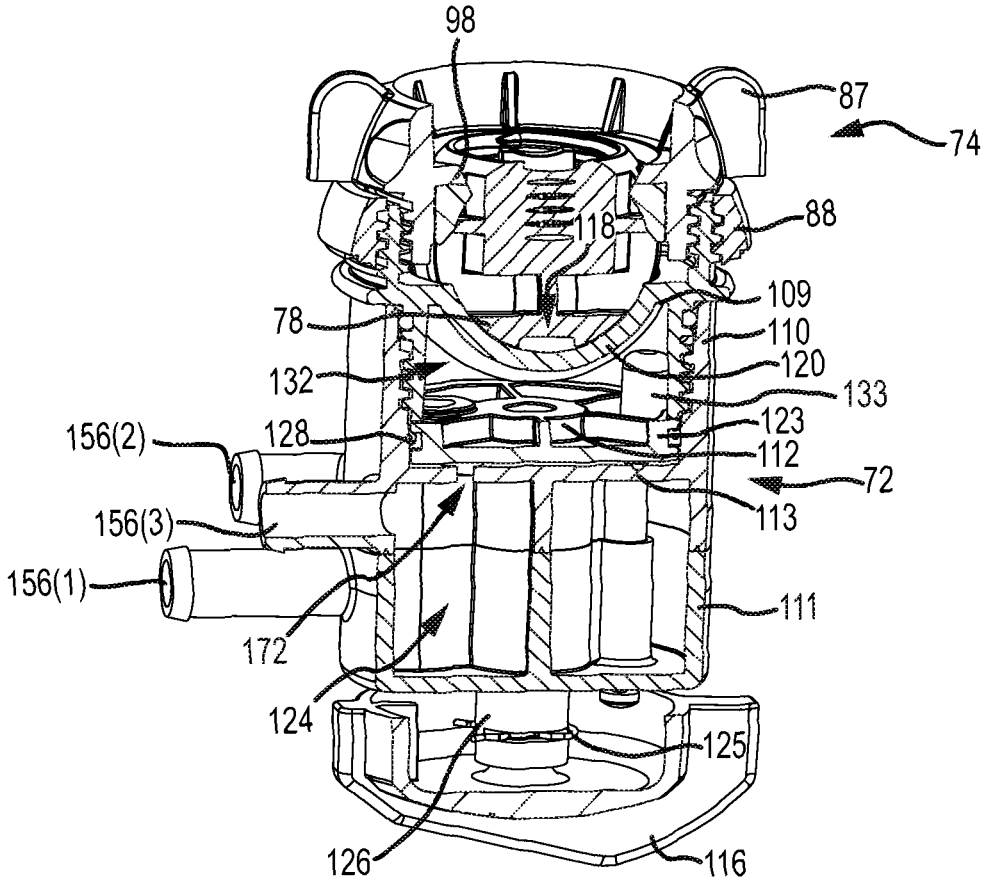
FIG. 6 is an isometric view in cross section of the mode selector along line 6-6 of FIG. 3.

As best shown in cross section in FIGS. 5 and 6, the pivot ball unit 76 may further include a water filter 85 that may be positioned inside the passage 86 defined in the ball 78. The water filter 85 may serve to remove impurities from the water flow from the water pipe 20 by any filtration technique, including a fine physical barrier, a chemical process or a biological process. In one embodiment, the water filter 85 may be a rigid or flexible screen that separates contaminants and other fine particles out of the water flow. The bottom end of the water filter 85 may include a threaded outer surface that is configured to couple to a second threaded inner surface 83 within the passage 86 of the ball 78, that is of smaller diameter than and below the first threaded inner surface 82, so that the water filter 85 is substantially immobile with respect to the ball 78 when these components are screwed together.

The pivot ball unit 76 may further include a regulator assembly 89 configured to control the flow of fluid received from the water pipe 20. The regulator assembly 89 may incorporate any conventional shower flow regulator and may be configured to couple to the water filter 85. For example, the regulator assembly 89 may reside within the ball 78 and may be positioned in the passage 86 below the water filter 85.

The pivot ball unit 76 may also include a seal 99 that is positioned in a channel 97 that extends around the circumference of a planar section of the ball 78 normal to a flow path through the passage 86. In one embodiment, the seal 99 may be an O-ring that encircles the channel 97. The O-ring seal 99 may engage the surface of a receiving component 109 configured to receive the ball 78 to prevent leaks from occurring as the water flow is passed from the water pipe 20 to the fluid distribution assembly 72.

Additionally, a second seal 84 may be positioned between the first threaded inner surface 82 of the ball 78 and the water pipe 20 to prevent leaks from occurring between the water pipe 20 and the first threaded inner surface 82. In one embodiment, the seal 84 may be seated on an annular shelf of the water filter 85 so as to engage the water pipe 20 when the first threaded inner surface 82 of the pivot ball unit 76 is screwed onto the water pipe 20.

Referring to FIGS. 3-6, the attachment structure 74 may further include a nut 87 and a collar 88 that are adjustably coupled to the fluid distribution assembly 72. The nut 87 includes a first end 90, a second end 92, and an aperture 94 that extends from the first end 90 to the second end 92. As best shown in FIGS. 5 and 6, the outer surface of the nut 87 includes a threaded surface 79 that is configured to couple to a mating threaded surface of the fluid distribution assembly 72. Additionally, the nut 87 includes an angled inner surface 98 that is located at the first end 90 of the nut 87. The angled inner surface 98 defines a plurality of protruding angled tabs 96 that are configured to remain in contact with an upper portion of the ball 78 of the pivot ball unit 76, as shown in FIGS. 5 and 6

The collar 88 may be adjustably coupled to the fluid distribution assembly 72. The collar 88 includes a first end 91, a second end 93, and an aperture 95 that extends from the first end 91 to the second end 93. The inner surface of the collar 88 may define a threaded surface 115 that extends between the first and second ends 91, 93 of the collar 88. The threaded surface 115 may couple to a mating first outer threaded surface 117 on the receiving component 109 of the fluid distributing assembly 72, as shown in FIG. 5.

The nut 87 and collar 88 may allow a user to pivotally adjust the shower arm 10 with respect to the water pipe 20. For example, after a user screws the threaded surface 115 of the collar 88 onto the first outer threaded surface 117 on the receiving component 109 of the fluid distribution assembly 72, the user may pivotally adjust the nut 87 relative to the ball 78 to a desired location. The threaded surface 79 of the nut 87 may then be screwed into a mating inner threaded surface 129 of the receiving component 109 of the fluid distribution assembly 72. This causes the protruding angled tabs 96 of the angled inner surface 98 of the nut 87 to tightly grip the ball 78 of the pivot ball unit 76, thereby pressing the O-ring seal 99 against the receiving surface 120 of the receiving component 109 to prevent the pivot ball unit 76 from easily moving relative to the water pipe 20.

The fluid distribution assembly 72 receives the water flow from the pivot ball unit 76 and directs the water flow to at least one of the water conduits 56(1, 2, 3) (as shown in FIG. 2). The fluid distribution assembly 72 may have a generally cylindrical shape and may fit snuggly within the chamber 70 of the base portion 54 of the arm structure 14. In one embodiment, the fluid distribution assembly 72 may be constructed using a plurality of components, including a upper distributor housing 110, a lower distributor housing 111, the receiving component 109, a distributor spool 112 rotatablyp coupled within the upper distributor housing 111, and a control knob 116 coupled to the distributor spool 112.

The receiving component 109 may reside within the upper distributor housing 110, and may define a concave hemispherical receiving surface 120 for receiving the ball 78 of the pivot ball unit 76. In one embodiment, the ball 78 may engage the receiving surface 120 as the shower arm 10 is pivoted around the water pipe 20. The receiving component 109 may further include a second threaded outer surface 119 that is configured to engage a mating threaded surface 131 on the interior of the upper distributor housing 110.

In one embodiment, the receiving surface 120 and the second threaded outer surface 119 of the receiving component 109 may define the top and sidewalls of a fluid distribution chamber 132. The receiving surface 120 may define an opening 118 for transmitting the water flow from the pivot ball unit 76 to the fluid distribution chamber 132. As will be further described below, the bottom wall of the fluid distribution chamber 132 may be defined by a disc portion 123 of the distributor spool 112.

The exterior of upper distributor housing 110 may define a generally cylindrical body including multiple outlet ports 156(2, 3). In one embodiment, each of the outlet pots 156(2, 3) may take the form of a barbed nozzle. The outlet pots 156(2, 3) may direct fluid out of the upper distributor housing 110 and into a respective attached fluid conduit 56(2, 3), into which a respective exit port 156(2, 3) may be inserted. A clamp 158 may be used to prevent leakage between the fluid conduits 56(2, 3) and the outlet pots 156(2, 3). Each outlet port 156(2, 3) may be designated a specific spray mode position or set of nozzles 30, thereby enabling the fluid distribution assembly 72 to direct water flow to one or more sets of nozzles 30.

Figure 8:
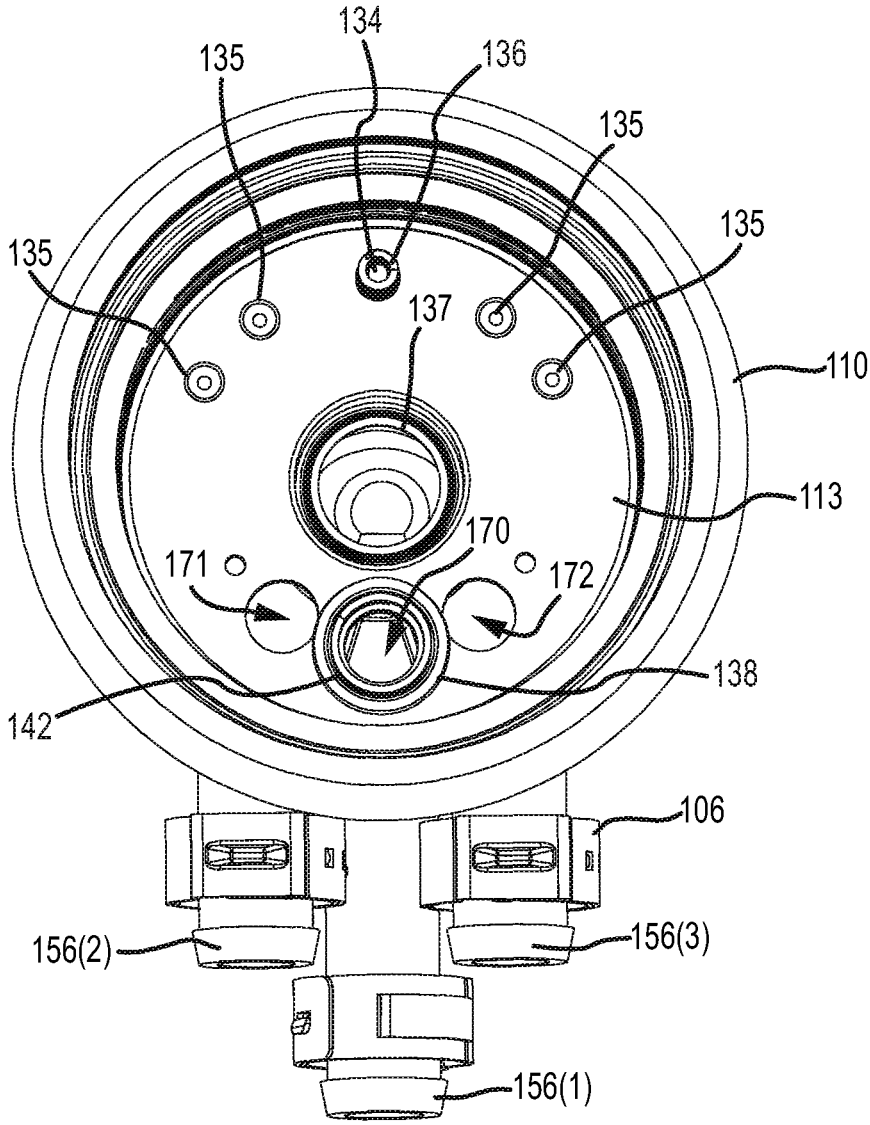
FIG. 8 is a top isometric view of the upper housing of the mode selector with the attachment mechanism, receiving component, and distributor spool removed.

The interior of the upper distributor housing 110 may define an annular shelf 113 surrounding a circular opening 137, and the top portions of three fluid distribution chambers 121, 122, 124 (the first two portions shown in FIGS. 6 and 5, respectively). A top plan view of the upper distributor housing 110, with the attachment structure 74 and receiving component 109 removed, is illustrated in FIG. 8. As shown in FIG. 8, each chamber 121, 122, 124 may have a respective chamber inlet 170, 171, 172 defined as bore holes in the annular shelf 113 of the upper distributor housing 110. Each chamber inlet 170, 171, 172 may be configured to direct water from the fluid distribution chamber 132 of the receiving component 109 to a particular chamber 124, 121, or 122 of the upper distributor housing 110. Additionally, the outlet pots 156(2, 3) of the upper distributor housing 110 may be configured to transport water flow from two of the fluid distribution chambers, for example, chambers 122 and 124 to connected fluid conduits 56(2, 3).

Figure 9:
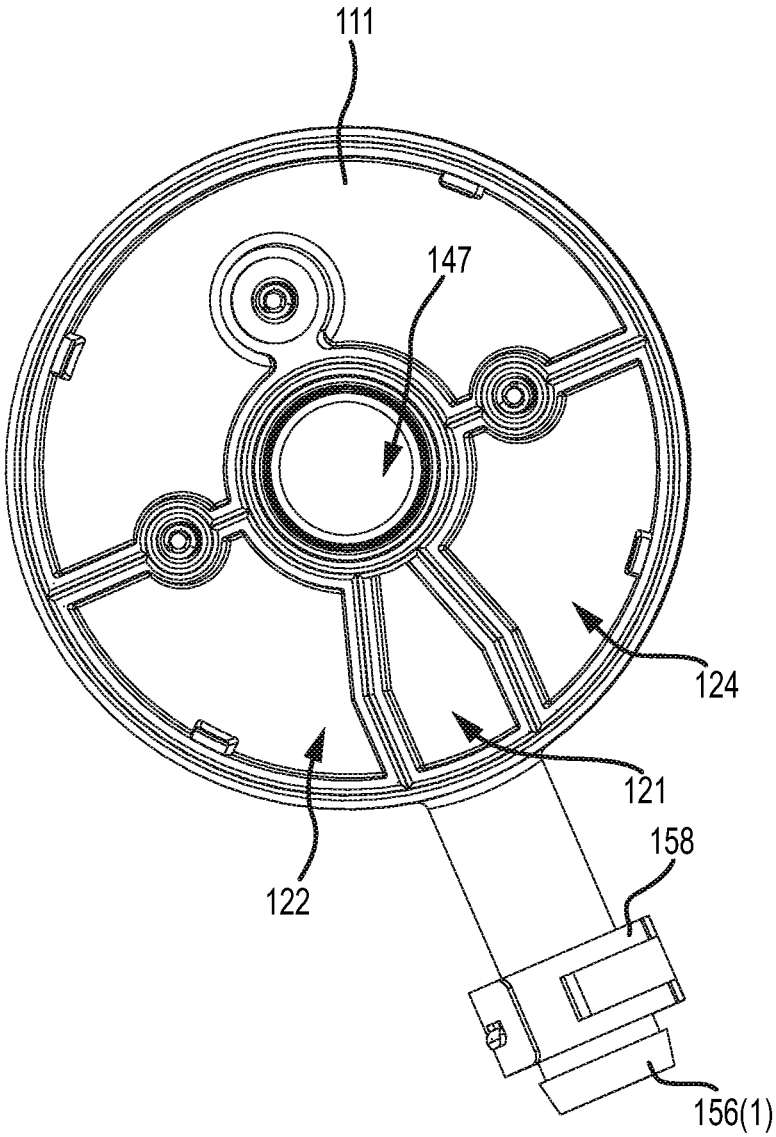
FIG. 9 is a top plan view of the mode selector with the attachment mechanism, receiving component, distributor spool, and upper distributor housing removed.

FIG. 9 illustrates a top plan view of the lower distributor housing 111, with the attachment structure 74, receiving component 109, and upper distributor housing 110 removed. The lower distributor housing 111 may be configured to fit over an end of the upper distributor housing 110 to complete the chambers 121, 122, 124 defined in the upper distributor housing 110. The lower distributor housing 111 may further define an outlet port 156(1) that may take the form of a barbed nozzle. The outlet port 156(1) may be configured to transport fluid from one of the fluid-holding chambers, for example, central chamber 121, into the attached fluid conduit 56(1). The fluid conduit 56(1) may be fitted over the outlet port 156(1), and a clamp 158 may be used to prevent leakage or the fluid conduit 56(1) from slipping off the outlet port 156(1). In one embodiment, the outlet port 156(1) of the lower distributor housing 111 may be vertically offset from the outlet pots 156(2, 3) of the upper distributor housing 110, thereby providing a more compact arrangement of the outlet pots 156(1, 2, 3), and a more compact arm structure 14 for housing the fluid conduits 56(1, 2, 3).

The distributor spool 112 may be rotatably received in the upper distributor housing 110. In one embodiment, the distributor spool 112 may include a disc portion 123 and a stem 126 that extends from the disc portion 123 and through concentric circular openings 137, 147 defined in the first and second distributor housings 110, 111. As best shown in FIGS. 5 and 6, the disc portion 123 of the distributor spool 112 may be seated on the shelf 113 defined in the upper distributor housing 110 such that the spool 112 is able to rotate thereon relative to the upper and lower distributor housings 110, 111.

Figure 7:
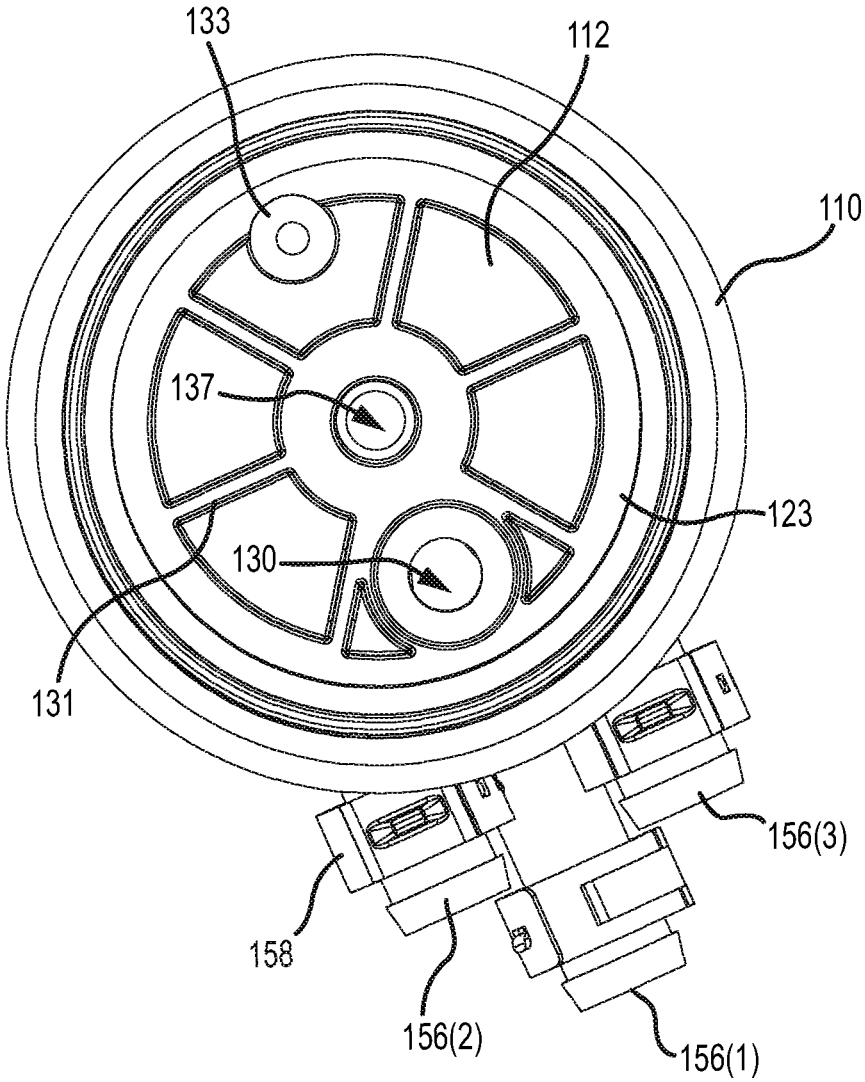
FIG. 7 is a top plan view of the distributor spool of the mode selector with the attachment mechanism and receiving component removed.

FIG. 7 illustrates a top plan view of the distributor spool 112 as seated in the upper distributor housing 110, with the attachment structure 74 and receiving component 109 removed. As shown in FIG. 7, the disc portion 123 of the distributor spool 112 may define a valve bore 130 radially offset from the stem 126, multiple spokes 131, and a positioning mechanism 133. Additionally, as best shown in cross section in FIG. 5, the disc portion 123 may define a cavity 141 below the valve bore 130 for receiving a cup-shaped valve seal 138 therein.

The rotation of the distributor spool 112 may be driven by the stem 126. In one embodiment, the control knob 116 of the mode selector 48 may be attached to the bottom end of the stem 126, thereby allowing a user to turn the distributor spool 112 within the distributor housing 110 to a select spray mode. The distributor spool 112 and may be attached to the control knob 116 via any attachment mechanism including, e.g., a retaining clip 125 that engages both the stem 126 of the distributor spool 112 and a nub 149 of the control knob 116 received in a hollow end 147 of the stem 126 so that the spool 112 and the control knob 116 rotate together.

The valve bore 130 of the disc portion 123 may extend through the disc portion 123 and form part of the water flow path extending from the pivot ball unit 76 to the chambers 121, 122, 124 defined by the upper and lower distributor housings 110, 111. For example, the distributor spool 112 may be rotated to various positions so as to align the valve bore 130 defined in the disc portion 123 with one of the chamber inlets 170, 171, 172 defined in the upper distributor housing 110 to allow fluid to pass from the fluid distribution chamber 132 defined by the receiving component 109 to one or more of the chambers 121, 122, 124 defined by the upper and lower distributor housings 110, 111.

The positioning mechanism 133 may facilitate the alignment of the valve bore 130 defined in the disc portion 123 with the chamber inlets 170, 171, 172 defined in the upper distributor housing 110. In one embodiment, the positioning mechanism 133 may include a detent characteristic to provide for a tactile feel to a user, which indicates to the user that the control knob 116 has transitioned from one spray mode position to another spray mode position. The positioning mechanism 133 is shown in cross section in FIG. 5, and may include a housing 139 defining a cavity for enclosing a pin 134 and spring 136. The pin 134 and spring 136 may be configured to engage a plurality of actuation recesses or detents 135 defined on the shelf 113 of the upper distributor housing 110 (as shown in FIG. 8) for each spray mode setting.

As the control knob 116 is turned by a user, the distributor spool 112 rotates within the upper and lower distributor housings 110, 111. When the valve bore 130 defined in the disc portion 123 is aligned with one of the chamber inlets 170, 171, 172 defined in the upper distributor housing 110, the spring 136 may bias the pin 134 into a selected detent 135 to lock or "click" the distributor spool 112 in place. When the pin 134 leaves one detent, such as when a user rotates the control knob 116, the spring 136 is depressed within the housing 139 of the positioning mechanism 133. In some embodiments, multiple modes may be selected at once by positioning the valve bore 130 between multiple chamber inlets 170, 171, 172 such that water flows to two bores (e.g., chamber inlets 170, 171 or chamber inlets 170, 172) at the same time.

The disc portion 123 of the distributor spool 112 may also house a cup-shaped valve seal 138 that is seated within a cavity 141 defined in the disc portion 123 below the valve bore 130. In one embodiment, a spring 142 may be positioned between the shelf 113 of the upper distributor housing 110 and the base of the cup-shaped valve seal 138 to bias the valve seal 138 downward against the shelf 113 of the upper distributor housing 110. The valve seal 138 may be made of a compliant material (e.g., rubber or other elastomer) capable of creating a relatively watertight seal when the valve seal 138 engages the surface of the shelf 113. Positioning the valve seal 138 against a flat surface, such as the surface defined by the shelf 113 of the upper distributor housing 110, as opposed to a curved surface, may reduce manufacturing costs associated with designing and manufacturing a valve seal for distribution of water in the mode selector 48. Positioning the valve seal 138 against a flat surface may also create a better seal between the surface of the shelf 113 and the seal 138 (e.g., better than a seal against the cylindrical inner walls of the upper or lower distribution housings 110, 111 with which the outlets ports 156(1, 2, 3) interface) that is less prone to failure when the spool 112 is rotated.

In one embodiment, the valve bore 130 may be oriented so that a center axis thereof is parallel to but radially apart from the axis of the chamber 132 of the receiving component 109. Accordingly, when the valve bore 130 defined in the disc portion 123 is aligned with one of the chamber inlets 170, 171, 172 defined in the upper distributor housing 110, the water flow is directed through the chamber 132 of the receiving component 109, through the valve seal 138, into a selected chamber 121, 122, 124 of the upper and lower distributor housings 110, 111, and through one of the outlet pots 156(1, 2, 3) of the upper and lower distributor housings 110, 111.

This configuration offers many advantages over prior mode selector designs, in which the valve bore 138 is oriented so that its axis is perpendicular to the axis of the fluid distribution chamber 132. For example, the described configuration allows for the use of a more compact mode selector 48 since the water flow is directed directly downward from the chamber 132 of the receiving component 109 to chambers 121, 122, 124 located below the receiving component chamber 132, rather than through a perpendicular path. Additionally, the described configuration may further reduce the manufacturing costs associated with the mode selector 48 because fewer rotating parts are required for directing the water flow to the fluid conduits 56.

The operation of one embodiment of the valve seal 138 in the mode selector 48 will now be described with respect to FIGS. 5 and 6. FIGS. 5 and 6 illustrate the distributor spool 112, as positioned to direct water flow from the fluid distribution chamber 132 of the receiving component 109 to the outlet port 156(1) defined in the lower distributor housing 111. In this position, the valve seal 138 may be biased by the spring 142 against the shelf 113 defined by the upper distributor housing 110 to form a seal around the circumference of the corresponding chamber inlet 170. The engagement of the valve seal 138 with the shelf 113 is sufficient to create a water-tight seal, but not so forceful as to significantly impede the rotation of the distributor spool 112 within the upper distributor housing 110.

The valve bore 130 and corresponding valve seal 138 may be moved to a plurality of positions as the spool 112 is rotated. As discussed above, FIGS. 5 and 6 illustrate the valve seal 138 as positioned adjacent a chamber inlet 172 of the upper distributor housing 110. The distributor spool 112 may also be reoriented in another position, such that the valve bore 130 and valve seal 138 may be transitioned from one chamber inlet 170, 171, 172 to another chamber inlet 170, 171, 172 of the upper distributor housing 110, thereby directing water flow from one outlet port 156(1, 2, 3) to another. In other embodiments, the valve bore 130 and valve seal 138 may be positioned partially out of alignment with a selected chamber inlet 170, 171, 172 to reduce the water flow through the selected outlet port 156(1, 2, 3), or positioned between chamber inlets 170, 171, or between chamber inlets 170, 172 to direct the water flow out of multiple outlet pots 156(1, 2) or outlet ports 156(1, 3), respectively.

The distributor spool 112 may also include a plurality of annular seals to prevent leakage between the various chambers 121, 122, 124, 132 defined by the receiving component 109 and the upper and lower distributor housings 110, 111. For example, the distributor spool 112 may include an annular seal 128 positioned around the periphery of the disc portion 123 and an annular seal 127 positioned around the periphery of the stem 126 to protect against water leakage between the distributor spool 112 and the upper and lower distributor housings 110, 111.

All directional references (e.g., proximal, distal, upper, lower, upward, downward, left, right, lateral, longitudinal, front, back, top, bottom, above, below, vertical, horizontal, radial, axial, clockwise, and counterclockwise) are only used for identification purposes to aid the reader's understanding of the present invention, and do not create limitations, particularly as to the position, orientation, or use of the invention. Connection references (e.g., attached, coupled, connected, and joined) are to be construed broadly and may include intermediate members between a collection of elements and relative movement between elements unless otherwise indicated. As such, connection references do not necessarily infer that two elements are directly connected and in fixed relation to each other. The exemplary drawings are for purposes of illustration only and the dimensions, positions, order and relative sizes reflected in the drawings attached hereto may vary.

The above specification, examples and data provide a complete description of the structure and use of exemplary embodiments of the invention. Although various embodiments of the invention have been described above with a certain degree of particularity, or with reference to one or more individual embodiments, those skilled in the art could make numerous alterations to the disclosed embodiments without departing from the spirit or scope of this invention. Other embodiments are therefore contemplated. It is intended that all matter contained in the above description and shown in the accompanying drawings shall be interpreted as illustrative only of particular embodiments and not limiting. Changes in detail or structure may be made without departing from the basic elements of the invention as defined in the following claims.

What is claimed is:

1. A showerhead comprising an arm structure configured to couple to a water pipe to receive water flow therefrom;

a first fluid conduit housed within the arm structure;

a second fluid conduit housed within the arm structure; and a mode selector housed within the arm structure and coupled to the first fluid conduit and the second fluid conduit to receive water flow from the water pipe and distribute the water flow to either the first fluid conduit, the second fluid conduit, or both, the mode selector comprising a valve seal; wherein the mode selector defines a first chamber, a second chamber, and a third chamber;

the first chamber is in fluid communication with the water flow from the water pipe;

the second chamber and the third chamber are both positioned downstream from the first chamber;

the mode selector further defines a first outlet port in fluid communication with the second chamber and a second outlet port in fluid communication with the third chamber;

the mode selector is configured to transition between a first setting to direct water flow through an aperture from the first chamber to the second chamber and a second setting to direct water flow through the aperture from the first chamber to the third chamber;

the valve seal seals against a substantially planar surface surrounding the aperture;

the second chamber is in fluid communication with the first fluid conduit through the first outlet port; and the third chamber is in fluid communication with the second fluid conduit through the second outlet port; and a spray head coupled to the support structure, the first fluid conduit, and the second fluid conduit, wherein the spray head is operably coupled with and configured to receive and distribute the water flow from the first and second fluid conduits.

2. The showerhead of claim 1, wherein the arm structure further comprises a base portion and the mode selector is positioned within the base portion.

3. The showerhead of claim 1, wherein the spray head comprises a plurality of nozzles operably coupled to the first fluid conduit.

4. The showerhead of claim 1, wherein the spray head comprises a plurality of nozzles operably coupled to the second fluid conduit.

5. The showerhead of claim 1, wherein the arm structure is configured to pivotally couple with the water pipe.

6. The showerhead of claim 1, wherein the mode selector further comprises a distributor spool defining the aperture and configured to rotate between a first position and a second position, wherein when the mode selector is at the first setting, the aperture is in the first position and provides fluid communication between the first chamber and the second chamber; and when the mode selector is at the second setting, the aperture is in the second position and provides fluid communication between the first chamber and the third chamber.

7. The showerhead of claim 6, wherein the valve seal is included within the distributor spool and positioned about the aperture, between the first chamber and each of the second and third chambers.

8. The showerhead of claim 1, further comprising a third fluid conduit housed within the arm structure; and wherein the mode selector further comprises a fourth chamber positioned downstream from the first chamber and in fluid communication with the third fluid conduit and a third outlet port in fluid communication with the fourth chamber; and the mode selector is further configured to transition to a third setting to direct water flow from the first chamber to the fourth chamber.

9. The showerhead of claim 1, wherein the first and second fluid conduits are hoses.

10. A showerhead comprising a connector portion configured for coupling to a water pipe and operable to receive water flow therefrom;

a mode selector connected to the connector portion and defining a first chamber, a second chamber, and a third chamber, the mode selector comprising a valve seal, wherein the second and third chambers are positioned downstream from the first chamber; and the mode selector is configured to receive the water flow from the water pipe in the first chamber and selectively direct the water flow through a valve bore to the second chamber and the third chamber, wherein the water flow maintains a substantially straight flow direction between the first chamber and either the second chamber or the third chamber;

a spray head portion operative to receive the water flow from the mode selector and distribute the water flow to a user;

a first fluid conduit coupled to and between the second chamber of the mode selector and the spray head portion and operable to transport the water flow from the mode selector to the spray head portion;

a second fluid conduit coupled to and between the third chamber of the mode selector and the spray head portion and operable to transport the water flow from the mode selector to the spray head portion; and the valve seal seals against a substantially planar surface surrounding the valve bore.

11. The showerhead system of claim 10, wherein the first and second fluid conduits are flexible hoses.

12. The showerhead system of claim 10, wherein the connector portion is configured to pivotally couple to the water pipe.

13. The showerhead system of claim 10, wherein the spray head portion comprises a first plurality of nozzles in fluid communication with the first fluid conduit and a second plurality of nozzles in fluid communication with the second fluid conduit.

14. The showerhead system of claim 10, wherein the mode selector further comprises a distributor spool defining a valve bore and the valve seal is positioned about the valve bore and between the first chamber and each of the second chamber and the third chamber, respectively, as the distributor spool is rotated.

15. The showerhead system of claim 10, wherein the mode selector further comprises a fourth chamber positioned below the first chamber and is further configured to selectively direct the water flow from the first chamber to the fourth chamber; and the showerhead system further comprises a third fluid conduit coupled to and between the fourth chamber of the mode selector and the spray head portion and operable to transport the water flow from the mode selector to the spray head portion.

16. The showerhead system of claim 10, wherein the mode selector further comprises a positioning mechanism configured to facilitate alignment of the mode selector to direct the water flow to the second chamber and alternately to the third chamber.

17. The showerhead system of claim 14, wherein the mode selector further comprises a positioning mechanism configured to facilitate the alignment of the valve bore of the distributor spool at a first position corresponding to a first fluid communication path between the first chamber and the second chamber and at a second position corresponding to a second fluid communication path between the first chamber and the third chamber.

18. A showerhead system comprising a spray head having a plurality of nozzles and configured to receive and distribute water flow through the plurality of nozzles to a user;

a support structure coupled to the spray head and configured to receive and transport water flow to the spray head;

a first fluid conduit housed within the support structure and coupled at a first end to a first channel in the spray head associated with a first set of the plurality of nozzles;

a second fluid conduit housed within the support structure and coupled at a first end to a second channel in the spray head associated with a second set of the plurality of nozzles; and a mode selector comprising a valve seal and defining an aperture, the mode selector configured to transition between a first position associated with a first chamber defined within the mode selector and a second position associated with a second chamber defined within the mode selector and thereby to direct water flow through the aperture from a third chamber defined within the mode selector to the first chamber and the second chamber, respectively, based on the selected first or second position, respectively, wherein the third chamber is positioned upstream from both the first and second chambers; and the valve seal seals against a substantially planar surface surrounding the aperture;

the mode selector further defines a first outlet port in fluid communication with the first chamber and a second outlet port in fluid communication with the second chamber; wherein the first outlet port is operatively coupled to a second end of the first fluid conduit and the second outlet port is operatively coupled to a second end of the second fluid conduit to transport water flow from the mode selector to the spray head.

19. The showerhead system of claim 18, further comprising an adjustment mechanism coupled to a base of the support structure to provide pivotal movement of the support structure in at least one direction relative to a water pipe and to positively lock the support structure in a user-adjusted position relative to the water pipe.

20. The showerhead system of claim 19, wherein the valve seal is positioned downstream from the third chamber and upstream from each of the first chamber and the second chamber.

21. The showerhead of claim 1, wherein the water flow maintains a substantially straight flow direction between the first chamber and either the second chamber or the third chamber.

22. The showerhead of claim 6, wherein the first and second outlet ports extend outward from an exterior surface of the mode selector in separate planes, each of which is perpendicular to an axis of rotation of the mode selector.

23. The showerhead of claim 18, wherein the first and second outlet ports extend outward from an exterior surface of the mode selector in separate planes, each of which is perpendicular to an axis of rotation of the mode selector.

* * * * *